US012546053B2

(12) United States Patent
Huang et al.

(10) Patent No.: US 12,546,053 B2
(45) Date of Patent: Feb. 10, 2026

(54) LIQUID STORAGE BOX, ADDITIVE DISPENSING APPARATUS AND IDENTIFICATION METHOD

(71) Applicants: QINGDAO HAIER DRUM WASHING MACHINE CO., LTD., Shandong (CN); HAIER SMART HOME CO., LTD., Shandong (CN)

(72) Inventors: Tao Huang, Shandong (CN); Baozhen Cheng, Shandong (CN); Bencai Huang, Shandong (CN)

(73) Assignees: QINGDAO HAIER DRUM WASHING MACHINE CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 301 days.

(21) Appl. No.: 18/560,026

(22) PCT Filed: Apr. 19, 2022

(86) PCT No.: PCT/CN2022/087704
§ 371 (c)(1),
(2) Date: Nov. 9, 2023

(87) PCT Pub. No.: WO2022/237470
PCT Pub. Date: Nov. 17, 2022

(65) Prior Publication Data

US 2024/0240384 A1 Jul. 18, 2024

(30) Foreign Application Priority Data

May 10, 2021 (CN) ..... 202110506309.8
May 19, 2021 (CN) ..... 202110545279.1
May 20, 2021 (CN) ..... 202110549120.7

(51) Int. Cl.
*D06F 39/02* (2006.01)
*D06F 34/14* (2020.01)
*D06F 103/60* (2020.01)

(52) U.S. Cl.
CPC ..... *D06F 39/022* (2013.01); *D06F 34/14* (2020.02); *D06F 2103/60* (2020.02)

(58) Field of Classification Search
CPC ..... D06F 39/022; D06F 34/14; D06F 2103/60
(Continued)

(56) References Cited

U.S. PATENT DOCUMENTS 11,186,936 B2 * 11/2021 Park ..... D06F 39/02
2005/0235704 A1 * 10/2005 Cho ..... D06F 39/02 68/112

(Continued)

FOREIGN PATENT DOCUMENTS

CN 102912588 A 2/2013
CN 204039768 U 12/2014

(Continued)

OTHER PUBLICATIONS

International Search Report (PCT/ISA/210) with English translation and Written Opinion (PCT/ISA/237) mailed on Jul. 25, 2022, by the Chinese Patent Office as the International Searching Authority for International Application No. PCT/CN2022/087704.

*Primary Examiner* — Paul R Durand
*Assistant Examiner* — Michael J. Melaragno
(74) *Attorney, Agent, or Firm* — Buchanan Ingersoll & Rooney PC

(57) ABSTRACT

A liquid storage box, an additive dispensing apparatus and an identification method including a guiding identifier part with a set guiding trajectory is arranged on the liquid storage box; and any one or a combination of the number, position and trajectory shape of the guiding identifier part corre-
(Continued)

spondingly represents types of additives. The additive dispensing apparatus has an intelligent identification assembly, including a first second wiring terminal connected to a detection circuit; elastic pushing members, including conductive elements in contact and electrical connection between the first and the second wiring terminal under normal conditions; and a rotating swing member, which may swing along the set guiding trajectory of the guiding identifier part on the liquid storage box and push the elastic pushing members at corresponding positions to disconnect the conductive elements from a wiring terminal when the liquid storage box is inserted into an insertion groove, achieving signal identification.

20 Claims, 15 Drawing Sheets

(58) Field of Classification Search
USPC ..... 222/52
See application file for complete search history.

(56) References Cited

U.S. PATENT DOCUMENTS

2009/0095750 A1* 4/2009 Vitan ..... A47L 15/4253 206/459.1
2010/0000022 A1* 1/2010 Hendrickson ..... D06F 39/022 68/4
2010/0071777 A1* 3/2010 Smith ..... D06F 39/022 222/325
2012/0024021 A1* 2/2012 Seo ..... D06F 39/028 137/215
2012/0096901 A1* 4/2012 Zattin ..... D06F 39/02 68/13 R
2014/0137608 A1* 5/2014 Seikel ..... D06F 39/02 68/17 R
2016/0215434 A1* 7/2016 Doyle ..... D06F 35/006
2016/0273150 A1* 9/2016 Del Pos ..... D06F 39/02
2018/0355543 A1* 12/2018 Cinello ..... D06F 39/02
2019/0153656 A1* 5/2019 Rios ..... D06F 37/06
2019/0368108 A1* 12/2019 Channal ..... D06F 34/04
2020/0232134 A1* 7/2020 Jung ..... D06F 39/028
2020/0232146 A1* 7/2020 Jung ..... D06F 39/02
2020/0232147 A1* 7/2020 Jung ..... D06F 39/02
2020/0325616 A1* 10/2020 Chae ..... D06F 39/083
2021/0002809 A1* 1/2021 Huang ..... D06F 39/02
2021/0017691 A1* 1/2021 Jo ..... D06F 39/12
2021/0062391 A1* 3/2021 Jung ..... D06F 39/02
2021/0062393 A1* 3/2021 Jung ..... D06F 39/12
2021/0062394 A1* 3/2021 Jung ..... D06F 39/12
2021/0062395 A1* 3/2021 Jung ..... D06F 39/022
2021/0062396 A1* 3/2021 Jung ..... D06F 39/028
2021/0189629 A1* 6/2021 Jung ..... D06F 39/02
2021/0222347 A1* 7/2021 Jung ..... D06F 39/028
2021/0301453 A1* 9/2021 Cinello ..... D06F 39/02
2021/0372026 A1* 12/2021 Huang ..... D06F 39/028
2022/0081824 A1* 3/2022 Huang ..... D06F 39/02
2022/0267941 A1* 8/2022 Huang ..... D06F 39/02
2023/0084319 A1* 3/2023 Dunn ..... D06F 25/00 68/12.15
2023/0272571 A1* 8/2023 Chun ..... D06F 39/022 68/12.18
2024/0240384 A1* 7/2024 Huang ..... D06F 34/14
2024/0263378 A1* 8/2024 Yim ..... D06F 39/08
2024/0376656 A1* 11/2024 Kwon ..... D06F 39/083
2025/0137181 A1* 5/2025 Damtew ..... D06F 39/02
2025/0146205 A1* 5/2025 Damtew ..... D06F 39/02
2025/0198074 A1* 6/2025 Damtew ..... D06F 39/022
2025/0270752 A1* 8/2025 Roetker ..... D06F 39/10

FOREIGN PATENT DOCUMENTS

CN 205141211 U 4/2016
CN 105722444 A 6/2016
CN 112144225 A 12/2020
TW 517374 B 1/2003
WO WO-2015199417 A1 * 12/2015 ..... D06F 39/022
WO 2019001290 A1 1/2019
WO WO-2019162408 A1 * 8/2019 ..... D06F 33/37
WO WO-2022149796 A1 * 7/2022 ..... D06F 39/02
WO WO-2022237436 A1 * 11/2022 ..... D06F 39/10
WO WO-2022252384 A1 * 12/2022 ..... D06F 39/022
WO WO-2023184809 A1 * 10/2023 ..... D06F 39/02

* cited by examiner

LIQUID STORAGE BOX, ADDITIVE DISPENSING APPARATUS AND IDENTIFICATION METHOD

TECHNICAL FIELD

The present disclosure relates to the technical field of clothing additive dispensing, in particular to a liquid storage box, an additive dispensing apparatus and an identification method.

BACKGROUND

At present, dispensing apparatuses matched with washing machines are gradually emerging, but the existing dispensing apparatuses only meet simple needs of users, and are far from standards of high-tech products with smart dispensing. Existing additive dispensing apparatuses generally have a plurality accommodating parts, each accommodating part is used for installing a liquid storage box, so as to enable the liquid storage boxes for storing different types of additives to be assembled on one additive dispensing apparatus at the same time, and thus the effects of selective or combined dispensing of the different types of additives by the dispensing apparatus are achieved.

However, for the existing external additive dispensing apparatuses, in a process of replacing the liquid storage boxes by the users, misplacement is prone to occurring. Especially due to the increased functions of the washing machines, the washing machines can automatically dispense detergents, stains, color protectors and softeners, all liquid storage boxes are distinguished into different types through identifiers, and the users need to learn the corresponding identifiers, which is prone to remembering or dispensing incorrectly.

The Chinese patent No. 201810617547.4 discloses a control method and apparatus for automatic dispensing of multiple clothing treatment agents in a washing machine. An automatic dispensing apparatus includes a fixed type treatment agent box for containing a fixed type clothing treatment agent and a variable type treatment agent box for containing one or multiple types of clothing treatment agents at the same time. The control method includes: the washing machine executes a washing program, and according to a selected clothing treatment agent in the fixed type treatment agent box and/or the variable type treatment agent box, the automatic dispensing apparatus executes a corresponding dispensing process.

The automatic dispensing apparatus disclosed in the above application can achieve an objective of targeted and intelligent dispensing of different pieces of clothing by setting the variable type treatment agent box that can select and controlling the dispensing of the clothing treatment agents in the variable type treatment agent box. However, the disclosed dispensing apparatus cannot identify the types of additives stored in the variable type treatment agent box, making it impossible to accurately dispense the additives based on their actual types in subsequent washing procedures.

In view of this, the present disclosure is proposed.

SUMMARY

The technical problem to be solved by the present disclosure is to overcome the defects in the prior art, a liquid storage box with its own function of recognizing identity information is provided, so as to achieve the objective of using a specific guiding identifier part with a set guiding trajectory to identify types of additives contained in an additive container. At the same time, the present disclosure further provides an additive dispensing apparatus, so as to achieve automatic identification of an identity identifier of an installed liquid storage box, so that the objective of identifying the types of the additives contained in the liquid storage box is achieved. Furthermore, the present disclosure further provides an identification method for an additive dispensing apparatus, so as to achieve the objective of automatically identifying and determining the types of the additives in the installed liquid storage box.

In order to solve the above technical problem, a basic concept of a technical solution adopted by the present disclosure is:

a liquid storage box, internally provided with a closed cavity for storing additives, wherein at least one guiding identifier part with a set guiding trajectory is arranged on an outer wall of the liquid storage box: and any one or a combination of the number, position and trajectory shape of the guiding identifier part arranged on the liquid storage box correspondingly represents types of the additives stored in the liquid storage box.

Further, the guiding identifier part is a guiding rib and/or a guiding groove arranged on the outer wall of the liquid storage box in an insertion and extraction direction of the liquid storage box: preferably, the guiding rib and/or the guiding groove is arranged on a top wall of the liquid storage box: and more preferably, in an insertion direction of the liquid storage box, the guiding rib and/or the guiding groove is arranged at a position, close to a front end, of the top wall of the liquid storage box.

Further, the top wall of the liquid storage box sinks inward to form the guiding groove, and the guiding groove has a guiding wall that can change a direction of the guiding trajectory: and/or the top wall of the liquid storage box protrudes outward to form the guiding rib, and the guiding rib has a guiding wall that can change the direction of the guiding trajectory.

Further, the liquid storage box has at least two set identifier positions, the guiding identifier parts are the guiding ribs and/or the guiding grooves arranged at the identifier positions, and numbers and/or positions of the guiding ribs and/or the guiding grooves arranged at the identifier positions of the liquid storage boxes for different types of additives are different.

Further, an identifier cover is arranged on the liquid storage box, and the guiding rib and/or the guiding groove is arranged on the identifier cover: preferably, the identifier cover is a part of the liquid storage box, and is arranged at a position, close to the front end, of the top wall of the liquid storage box: more preferably, a top wall of a box body of the liquid storage box is provided with an opening, and the identifier cover is installed on the opening: or the identifier cover is integrally formed with the box body of the liquid storage box.

Further, another objective of the present disclosure further provides an additive dispensing apparatus, provided with an insertion groove for installing the above liquid storage box, an intelligent identification assembly for identifying types of additives in the liquid storage box is correspondingly arranged in the insertion groove, the intelligent identification assembly includes: a wiring terminal, including a first wiring terminal and a second wiring terminal which are connected to a detection circuit; elastic pushing members, including conductive elements that are in contact and electrical connection between the first wiring terminal and the second wiring terminal under normal conditions; and a rotating swing member, which may swing along the set guiding trajectory of the guiding identifier part on the liquid storage box and push the elastic pushing members at corresponding positions to disconnect the conductive elements from the wiring terminal when the liquid storage box is inserted into the insertion groove, achieving signal identification. Preferably, there are a plurality of groups of wiring terminals, elastic pushing members and rotating swing members, which may cover and identify the guiding identifier parts at all identifier positions on the liquid storage boxes for different types of additives.

Further, the additive dispensing apparatus includes an upper cover plate located at a top of the insertion groove, the rotating swing member includes a swing part, wherein a rotating shaft which is rotatably connected to the upper cover plate is arranged on an upper end surface of the swing part, a guiding column is arranged on a lower end surface of the swing part, and the guiding column may move along the guiding trajectory of the guiding identifier part to drive the swing part to swing: an abutting part, connected to the swing part at a set included angle, deflecting with the swinging of the swing part, and extruding the elastic pushing members to disconnect the conductive elements from the wiring terminal: preferably, the swing part is a swing block, and the abutting part is an abutting plate connected to a side of the swing block at a certain included angle; and more preferably, the swing block is integrally formed with the abutting plate, and a connection included angle between the swing block and the abutting plate is greater than 90°.

Further, each elastic pushing member includes: a barrel shell, fixed to the upper cover plate: a sliding push rod, with one end located outside the barrel shell and abutting against the abutting part, and the other end extending into the barrel shell to abut an end of each conductive element: and a conductive element, movably arranged in the barrel shell, with two ends being in contact and electrical connection with the first wiring terminal and the second wiring terminal respectively. The rotating swing member swings to drive the abutting part to deflect and abut against the sliding push rod, and the sliding push rod pushes the conductive element to move, so as to disconnect at least one end of the conductive element from its corresponding wiring terminal, achieving signal identification: preferably, the conductive element includes a conductive spring installed in the barrel shell in a limited mode and conductive contact pieces connected to two ends of the conductive spring: and preferably, an outer diameter of one end of the sliding push rod abutting against the abutting part is enlarged.

Further, the intelligent identification assembly is fixed to the upper cover plate through an installation seat, the installation seat is internally provided with an accommodating cavity, and the elastic pushing member is installed in the accommodating cavity: and preferably, the installation seat is open on a side close to the rotating swing member, an extension connecting wall is connected to an edge of a top wall of the installation seat, and a rotating shaft of the rotating swing member is rotatably connected to the extension connecting wall. Preferably, one end of the wiring terminal is fixed to the top wall of the installation seat and connected to the external detection circuit, and the other end of the wiring terminal extends into the barrel shell to be in contact connection with the conductive element.

Further, another objective of the present disclosure further provides an identification method with the above additive dispensing apparatus, including: a liquid storage box being inserted into an insertion groove of the additive dispensing apparatus: a guiding identifier part arranged on the liquid storage box abuts and guides a corresponding rotating swing member in the insertion groove, so that conductive elements at corresponding identifier positions being disconnected from their corresponding wiring terminals: and acquiring signal information of the wiring terminals disconnected from each conductive element, and determining types of additives in the liquid storage box based on the signal information of the wiring terminals disconnected from each conductive element.

After adopting the above technical solution, compared with the prior art, the present disclosure has the following beneficial effects.

In the present application, through the plurality of guiding identifier parts with the set guiding trajectory arranged on the outer wall of the liquid storage box, the types of the additives contained in the liquid storage box are accurately identified by using any one or a combination of information such as the number, position and trajectory shape of the guiding identifier parts, so that significant technological progress in clearly identifying category information of the additives in different liquid storage boxes is achieved.

Through the above settings, after different types of liquid storage boxes are inserted into the insertion groove of the additive dispensing apparatus respectively, the guiding identifier parts with different numbers and/or positions arranged on different liquid storage boxes abut and guide the rotating swing member corresponding to the intelligent identification assembly arranged on the additive dispensing apparatus, so that the conductive elements at corresponding identifier positions are disconnected from the wiring terminal corresponding thereto, the objective of forming different detection signals for the wiring terminals with different numbers and different positions after different liquid storage boxes are installed in the additive dispensing apparatus is achieved, so as to achieve the effects of identifying the category information of the additives represented by the guiding identifier parts arranged on the liquid storage boxes.

Through the above method, the types of the additives in the liquid storage box are determined according to the signal information of the wiring terminals disconnected from each conductive element, and the identity of the liquid storage box installed in the additive dispensing apparatus may be accurately identified, so that significant technological progress in automatic and accurate identification of the types of the additives is achieved.

The technical problem to be solved by the present disclosure is to overcome the defects in the prior art, a sealing cover of a liquid storage box, a dispensing apparatus and a clothing treatment device are further provided, an identification apparatus for identifying categories and/or remaining quantities of additives in the liquid storage box is arranged on the sealing cover of the liquid storage box, the identification and detection of the types or remaining quantities of the additives can be achieved, and the production difficulty and cost of the liquid storage box can further be reduced.

In order to solve the above technical problem, a basic concept of a technical solution adopted by the present disclosure is:

a sealing cover of a liquid storage box, installed at a dispensing port of the liquid storage box, and the dispensing port is closed under normal conditions to form a closed cavity for storing additives in the liquid storage box: and an identification apparatus for identifying categories and/or remaining quantities of the additives in the liquid storage box is arranged on the sealing cover.

Further, the identification apparatus includes at least two conductive contact pieces which are in contact with the additives in the liquid storage box and arranged on the sealing cover, and any one or a combination of numbers and positions of the conductive contact pieces arranged on the sealing cover correspondingly represents the types of the additives stored in the liquid storage box.

Further, first conductive contact pieces and second conductive contact pieces which are spaced at different intervals are arranged on the sealing cover, and the interval correspondingly represents the types of the additives stored in the liquid storage box. Preferably, the interval includes distance information, relative spatial orientation information and position information arranged on the liquid storage box between the first conductive contact pieces and the second conductive contact pieces.

Further, the identification apparatus further includes conductive probes arranged on the sealing cover and extending into the closed cavity, the conductive contact pieces exposed on an outer wall surface of the sealing cover are connected to the conductive probes, and the conductive contact pieces are conducted with the additives in the closed cavity through the conductive probes. Preferably, one ends of the conductive probes are connected to the sealing cover, and the other ends of the conductive probes extend into the closed cavity: and the ends of the conductive probes connected to the sealing cover directly form the conductive contact pieces, or contact pieces independently arranged on the sealing cover and in contact with the conductive probes form the conductive contact pieces.

Further, the sealing cover includes a connecting sleeve with an outlet end located at the dispensing port of the liquid storage box and an inlet end extending into the liquid storage box, and the connecting sleeve is internally provided with a flow guide channel: and the sealing cover further includes a clamping end cap connected to the outlet end of the connecting sleeve and installed at the dispensing port in a sealing mode, and the conductive contact pieces are arranged on the clamping end cap. Preferably, one ends of the conductive probes are connected to the conductive contact pieces, and the other ends of the conductive probes extend into the connecting sleeve; or one ends of the conductive probes are connected to the conductive contact pieces, and the other ends of the conductive probes extend into the liquid storage box. More preferably, the conductive probes are embedded into a sleeve wall of the connecting sleeve, and the conductive contact pieces are exposed outside the clamping end cap; and the conductive contact pieces protrude from an outer wall surface of the clamping end cap, or are embedded into an outer wall of the clamping end cap.

Further, the identification apparatus further includes at least one photosensitive component arranged on the sealing cover, and any one or any combination of the number, position and transmittance of the photosensitive component correspondingly represents the types of the additives stored in the liquid storage box. Preferably, the photosensitive component is one or more light blocking parts arranged on the sealing cover, and any one or any combination of the number and/or position and/or thickness and/or material and/or color of the light blocking parts arranged on the sealing cover correspondingly represents the types of the additives stored in the liquid storage box. More preferably, the light blocking parts have multiple arrangement and combination forms according to different positions and numbers of the light blocking parts arranged on the sealing cover, and the light blocking parts with different arrangement and combination forms correspondingly represent different types of the additives stored in the liquid storage box.

Further, the identification apparatus further includes crystal oscillators which are arranged in the sealing cover and may generate different frequencies, the crystal oscillators with different frequencies correspond to different pieces of parameter information of the additives contained in the liquid storage box, and the parameter information at least includes the category information of the additives. Preferably, the crystal oscillators include crystal oscillators which are arranged in the sealing cover and may generate different frequencies, and first contacts and second contacts connected to two ends of the crystal oscillators respectively, and the first contacts and the second contacts are used for contact electrical connection between the crystal oscillators and an external circuit.

Further, the identification apparatus further includes at least one concave-convex part arranged on an outer wall of the sealing cover, and a combination of the number and position of the concave-convex part arranged on the sealing cover correspondingly represents the types of the additives stored in the liquid storage box; and preferably, a first concave-convex part and a second concave-convex part which are spaced at an interval are arranged on the sealing cover, and the interval correspondingly represents the types of the additives stored in the liquid storage box. More preferably, the interval includes distance information, relative spatial orientation information and position information arranged on the sealing cover between the first concave-convex part and the second concave-convex part.

Another objective of the present disclosure further provides a dispensing apparatus, having at least one insertion groove, a liquid storage box is installed in the insertion groove, the liquid storage box is provided with a dispensing port is formed in the liquid storage box, and the above sealing cover is installed at the dispensing port of the liquid storage box: and the dispensing apparatus further includes a dispensing unit, and the dispensing unit communicates with an interior of the liquid storage box through the sealing cover.

A third objective of the present disclosure is to provide a clothing treatment device, provided with the above dispensing apparatus, and automatic dispensing of additives is achieved through the dispensing apparatus.

After adopting the above technical solution, compared with the prior art, the present disclosure has the following beneficial effects.

According to the present disclosure, the identification apparatus for identifying categories and/or remaining quantities of the additives in the liquid storage box is arranged on the sealing cover of the liquid storage box, the identification and detection of the types or remaining quantities of the additives can be achieved, and the production difficulty and cost of the liquid storage box can further be reduced.

The technical problem to be solved by the present disclosure is to overcome the defects in the prior art, an intelligent identification assembly, an additive dispensing apparatus and an identification method are provided, after a liquid storage box is inserted, concave-convex parts with different positions and/or different numbers on the liquid storage box will be in contact with swing triggering members at corresponding positions to push the different swing triggering members to rotate upward, so that conductive spring pieces at corresponding positions are in contact conduction with wiring terminals, and thus circuit conduction is achieved to output signals. The numbers and/or positions of the concave-convex parts on the liquid storage box for different types of additives are different, and the pushed swing triggering members are different, which can output different combinations of detection signals, so as to achieve an effect of accurately identifying the types of the additives in the liquid storage box.

In order to solve the above technical problem, a basic concept of a technical solution adopted by the present disclosure is:

an intelligent identification assembly, including: contact switches including wiring terminals and conductive spring pieces which are correspondingly arranged and may be in contact or disconnected, and the conductive spring pieces and the wiring terminals being in a disconnected state in an initial state; and swing triggering members, which are arranged on one sides of the contact switches close to the conductive spring pieces in a swinging mode and may push the conductive spring pieces to be in contact conduction with the wiring terminals when the swing triggering members swing under an external force.

Further, there are a plurality of groups of contact switches and a plurality of swing triggering members, and the swing triggering members are arranged in one-to-one correspondence with the contact switches; and when swinging under the external force, the swing triggering members with different positions and/or numbers correspondingly push the conductive spring pieces with corresponding positions and/or corresponding numbers to be in contact connection with the wiring terminals.

Further, the intelligent identification assembly further includes an installation shell, and the installation shell includes: an upper shell body, the contact switches being arranged in the upper shell body: and a lower cover plate, and the swing triggering members being installed below the lower cover plate in an up-down swinging mode. The swing triggering members include swinging rods with one ends rotatably connected below the lower cover plate, and the other ends that may push the conductive spring pieces to move upward to be in contact connection with the wiring terminals. Preferably, the ends of the swinging rods in contact with the conductive spring pieces are provided with spring piece ejection parts protruding upward, and holes are formed in positions on the lower cover plate corresponding to the spring piece ejection parts: when the swinging rods swing upward, the spring piece ejection parts extend from the holes into the upper shell body to push the conductive spring pieces to move upward to be in contact connection with the wiring terminals; and more preferably, the spring piece ejection parts are ejection columns connected to the swinging rods at an included angle of not less than 90°.

Further, each swinging rod includes a swinging rod body and a swinging rod pushing part for assisting in pushing the swinging rod to move upward, and the swinging rod pushing part is a protrusion arranged below the swinging rod body; preferably, the protrusion is a plate-shaped convex rib connected below the swinging rod body, and the plate-shaped convex rib includes an inclined guiding wall gradually inclined downward from one side of the swinging rod close to a rotating end to the spring piece ejection part: and more preferably, the plate-shaped convex rib is arranged at a position of one side of the swinging rod body close to the spring piece ejection part.

Further, each swinging rod further includes a swinging rod limiting part for limiting a displacement of the swinging rod falling downward: and preferably, the swinging rod limiting part is a limiting section formed by outward extension of an end on one side of the swinging rod body provided with a rotating shaft hole, a limiting step in limited fit with the limiting section is correspondingly arranged on the lower cover plate, and the limiting step has a limiting top wall for limiting the limiting section from moving upward. More preferably, a connecting lug is arranged above the swinging rod, the rotating shaft hole is formed in the connecting lug, the lower cover plate is provided with an arc avoidance groove for avoiding rotation of the connecting lug, and the arc avoidance groove is connected to the limiting step.

Further, a plurality of strip-shaped convex blocks are arranged on a bottom wall of the lower cover plate, and an interval space that may accommodate the swinging rod is formed between two adjacent convex blocks; a first rotating shaft is arranged on each convex block, a rotating shaft hole is formed in one end of the swinging rod away from the spring piece ejection part, and the swinging rod is rotatably installed on the lower cover plate through the rotating shaft hole and the first rotating shaft; and preferably, a circumferential edge of the lower cover plate is folded downward to form a flanging structure, the convex blocks are arranged at intervals in a width direction of the lower cover plate, a second rotating shaft is arranged between the flanging structure and the convex blocks, and the swinging rod is rotatably installed on the first rotating shaft and/or the second rotating shaft.

Further, the intelligent identification assembly further includes a waterproof pad arranged on the lower cover plate and between the conductive spring pieces, and the waterproof pad at least covers upper parts of the holes: preferably, the waterproof pad is a flexible rubber film covering the upper part of the whole lower cover plate, and includes flexible telescopic sleeves correspondingly covering the upper parts of the holes: and more preferably, convex columns protruding upward are arranged in middle positions of the flexible telescopic sleeves.

Further, each conductive spring piece is a long strip-shaped spring piece structure, one end of the conductive spring piece is a fixed end, and the other end of the conductive spring piece is a free end: each wiring terminal includes: a first wiring terminal, electrically connected to the fixed end of the spring piece structure; and a second wiring terminal, correspondingly arranged above the free end of the conductive spring piece, wherein the free end of the conductive spring piece structure may be in contact with or separated from the second wiring terminal under the pushing of each swing triggering member: and preferably, it further includes a PCB fixedly arranged above the lower cover plate, and the first wiring terminal and the second wiring terminal are conductive contacts integrally arranged on the PCB.

Another objective of the present disclosure further provides an additive dispensing apparatus, including a liquid storage box and an accommodating part for installing the liquid storage box, and the above intelligent identification assembly is arranged in the accommodating part.

At least one concave-convex part is arranged on an outer wall of the liquid storage box, and any one or a combination of the number and position of the concave-convex parts arranged on the liquid storage box correspondingly represents types of additives stored in the liquid storage box: positions of swing triggering members correspond to positions of the concave-convex parts, and may cover all concave-convex parts on the liquid storage boxes for different types of additives: each concave-convex part on the liquid storage box abuts against the swing triggering member at a corresponding position to extrude the swing triggering member to swing towards a direction close to the conductive spring pieces: preferably, the concave-convex parts are arranged on a top wall of the liquid storage box, the accommodating part is composed of an insertion groove for installing the liquid storage box and an integrated cover plate arranged above the insertion groove, and the intelligent identification assembly is correspondingly installed on the integrated cover plate: and more preferably, it further includes an identification unit, which determines the types of the additives in the liquid storage box based on information of contact switches in contact with the concave-convex parts.

Another objective of the present disclosure further provides an identification method for the above additive dispensing apparatus, including: a liquid storage box being inserted into an accommodating part of the additive dispensing apparatus: each concave-convex part on the liquid storage box abutting against swing triggering members of an intelligent identification assembly, so that the swing triggering members swing towards a direction close to conductive spring pieces, so as to push the conductive spring pieces at corresponding positions to be in contact conduction with wiring terminals: and determining types of additives in the liquid storage box based on signal information of the wiring terminals in contact conduction with each conductive spring piece.

After adopting the above technical solution, compared with the prior art, the present disclosure has the following beneficial effects.

In the present application, a plurality of concave-convex parts exposed on the outer wall are arranged on the liquid storage box, and the categories of the additives contained in the liquid storage box are accurately identified by using any one or a combination of information such as the quantity, relative positions and positions on the liquid storage box of the concave-convex parts, so that significant technological progress in clearly identifying category information of the additives in different liquid storage boxes is achieved.

Through the above settings, after different types of liquid storage boxes are inserted into the accommodating part of the additive dispensing apparatus, the concave-convex parts with different positions and/or different numbers on the liquid storage boxes will be in contact with the swing triggering members at corresponding positions to push the different swing triggering members to rotate upward, so that the conductive spring pieces at corresponding positions are in contact conduction with the wiring terminals, and thus circuit conduction is achieved to output signals. Since the numbers and/or positions of the concave-convex parts on the liquid storage boxes for different types of additives are different, the pushed swing triggering members are different, and on-off situations of all contact switches are also different, so that the intelligent identification assembly can output different combinations of detection signals, and achieve an effect of accurately identifying type information of the additives represented by the concave-convex parts arranged on the liquid storage boxes.

Through the above method, the types of the additives in the liquid storage box are determined according to the signal information of the wiring terminals in contact conduction with each conductive spring piece, and the identity of the liquid storage box installed in the additive dispensing apparatus may be accurately identified, so that significant technological progress in automatic and accurate identification of the types of the additives is achieved.

Specific implementations of the present disclosure are further described in detail below in conjunction with accompanying drawings.

BRIEF DESCRIPTION OF THE DRAWINGS

Accompanying drawings, constituting a part of the present disclosure, are used for providing a further understanding of the present disclosure, schematic embodiments of the present disclosure and description thereof are used for explaining the present disclosure, and do not constitute an improper limitation on the present disclosure. Apparently, the accompanying drawings in the following description are only some embodiments, for those ordinarily skilled in the art, on the premise of no creative labor, other accompanying drawings can further be obtained from these accompanying drawings. In the figures.

Figure 1:
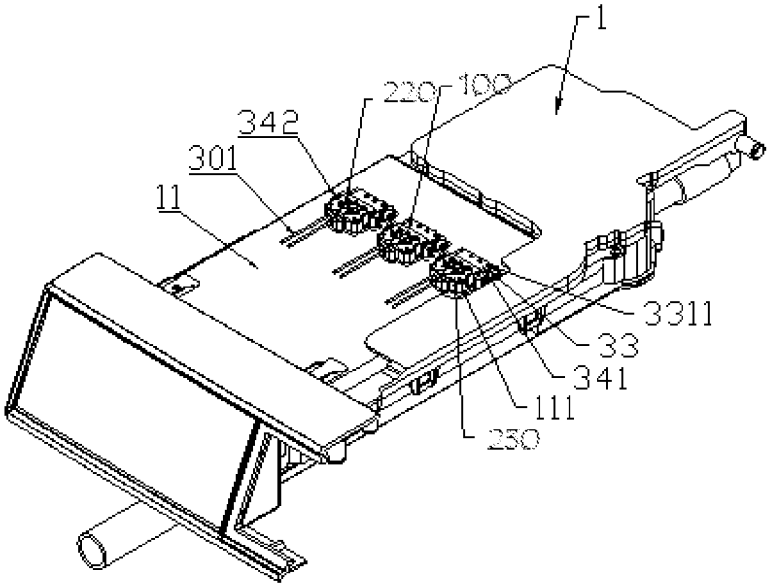
FIG. 1 is a schematic structural diagram from one angle of an additive dispensing apparatus of the present disclosure.

Description of main components in the figures: 1, additive dispensing apparatus; 11, upper cover plate; 111, limiting block rib; 2, liquid storage box; 21, guiding identifier part; 211, guiding rib; 2111, guiding wall; 201, identifier cover; 202, one-way breather valve; 100, intelligent identification assembly; 301, detection wire; 230, PCB; 220, wiring terminal; 311, first wiring terminal; 312, second wiring terminal; 32, elastic pushing member; 321, barrel shell; 3211, limiting installation groove; 322, sliding push rod; 323, conductive spring; 33, rotating swing member; 331, swing block; 3311, rotating shaft; 3312, guiding column; 332, abutting plate; 34, installation seat; 341, extension connecting wall; 342, clamping jaw; 343, limiting convex rib; Z1, first identifier position; Z2, second identifier position; Z3, third identifier position;

100, intelligent identification assembly; 200, contact switch; 210, conductive spring piece; 300, swing triggering member; 310, swinging rod body; 320, spring piece ejection part; 330, swinging rod pushing part; 3310, inclined guiding wall; 340, swinging rod limiting part; 350, connecting lug; 3510, rotating shaft hole; 4, installation shell; 41, upper shell body; 411, connection part; 4111, threaded hole; 412, extension plate; 4121, clamping groove; 413, positioning insertion groove; 42, lower cover plate; 421, arc avoidance groove; 422, strip-shaped convex block; 423, flanging structure; 424, hole; 425, limiting groove; 426, clamping platform; 427, limiting support plate; 4271, limiting column; 428, positioning insertion plate; 429, limiting step; 5, waterproof pad; 51, flexible telescopic sleeve; 52, convex column; 2, liquid storage box; 61, concave-convex part; 201, identifier cover; 71, accommodating part; 72, integrated cover plate; 721, installation opening; 722, bolt column;

2001, sealing cover; 2011, clamping end cap; 2012, turnover clamping wall; 2013, flow guide channel; 2014, directional liquid inlet pipeline; 2015, conductive contact piece; 2016, conductive component; 2017, concave-convex part; 2018, third contact; 2019, electronic label; 101, fourth contact; 102, light blocking protrusion; 103, conductive probe; 2100, dispensing unit; 2101, external line; 2103, closed cavity; and 2104, box body.

It should be noted that these accompanying drawings and textual descriptions are not intended to limit the conceptive scope of the present disclosure in any way, but to illustrate the concept of the present disclosure to those skilled in the art by referring to specific embodiments.

DETAILED DESCRIPTION

In order to make objectives, technical solutions and advantages of embodiments of the present disclosure clearer, the technical solutions in the embodiments will be clearly and completely described below in conjunction with accompanying drawings in the embodiments of the present disclosure, and the following embodiments are used to illustrate the present disclosure, but not to limit the scope of the present disclosure.

In the description of the present disclosure, it should be noted that the terms "mounted", "connected" and "connection" should be understood in a broad sense unless otherwise specified and defined, for example, "connection" may be fixed connection or detachable connection or integrated connection, may be mechanical connection or electric connection, and may be direct connection or indirect connection through an intermediate medium. For those ordinarily skilled in the art, the specific meanings of the above terms in the present disclosure may be understood in specific situations.

The present disclosure is further illustrated in detail below in conjunction with the embodiments.

Embodiment 1

As shown in FIG. 1 to FIG. 6, this embodiment provides a liquid storage box 2, having a closed cavity for storing additives, and at least one guiding identifier part 21 with a set guiding trajectory is arranged on an outer wall of the liquid storage box 2. Any one or a combination of the number, position and trajectory shape of the guiding identifier part 21 arranged on the liquid storage box 2 correspondingly represents types of the additives stored in the liquid storage box 2.

Figure 2:
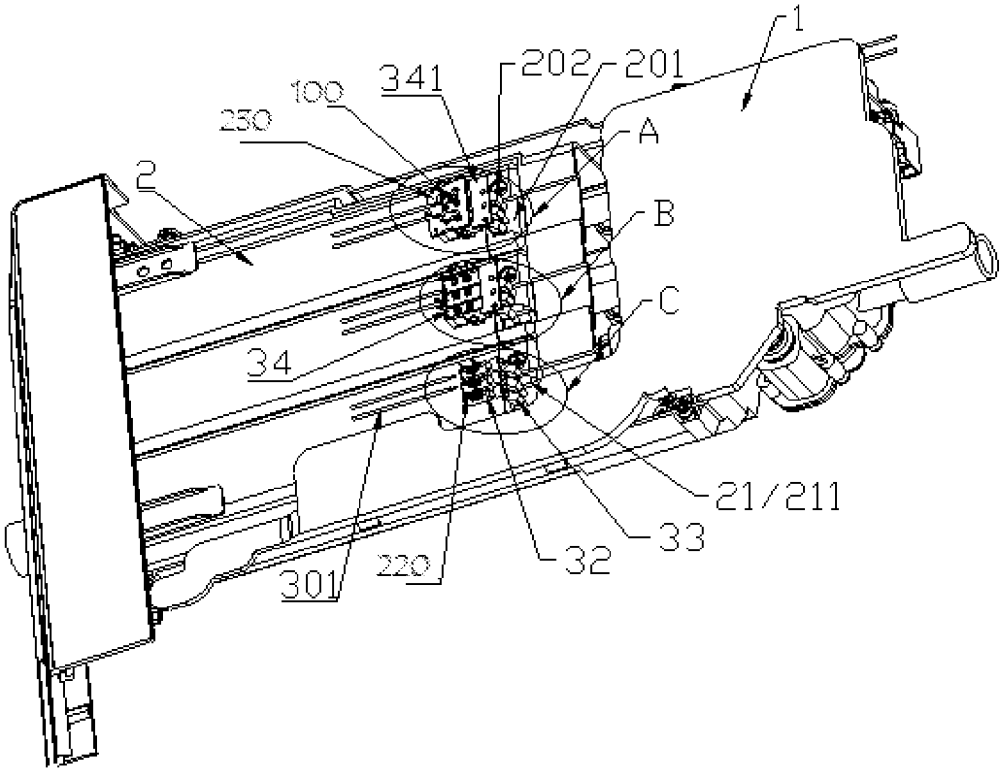
FIG. 2 is a schematic structural diagram from another angle of an additive dispensing apparatus of the present disclosure.
Figure 3:
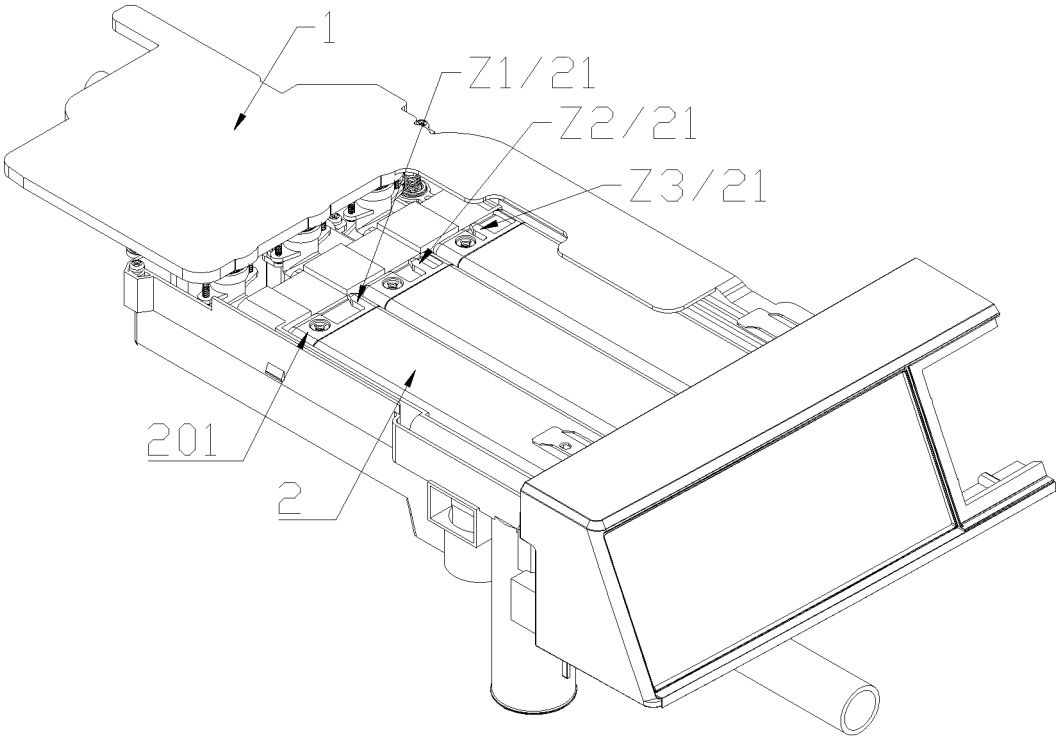
FIG. 3 is a schematic structural diagram of FIG. 1 after removing an upper cover plate and an intelligent identification assembly.

In this embodiment, as shown in FIG. 2 and FIG. 3, through the plurality of guiding identifier parts 21 with the set guiding trajectories arranged on the outer wall of the liquid storage box 2, the types of the additives contained in the liquid storage box 2 are accurately identified by using any one or a combination of information such as the number, position and trajectory shape of the guiding identifier parts 21, so that significant technological progress in clearly identifying category information of the additives in different liquid storage boxes 2 is achieved. Further, the liquid storage box 2 is arranged in an insertion groove of an additive dispensing apparatus in an insertion and extraction mode, and the guiding identifier parts 21 are guiding ribs 211 and/or guiding grooves arranged on the outer wall of the liquid storage box 2 in an insertion and extraction direction of the liquid storage box 2.

In this embodiment, the guiding ribs 211 and/or the guiding grooves may be arranged on a bottom wall or top wall of the liquid storage box 2, or on other side walls of the liquid storage box 2 in contact with the insertion groove. Therefore, when the liquid storage box 2 is inserted into the insertion groove, an intelligent identification assembly 100 arranged on the insertion groove corresponding to the guiding identifier parts 21 may move along a guiding trajectory of each guiding rib 211 and/or each guiding groove, causing a position to shift, achieving signal identification, so as to achieve an objective of determining identity of the liquid storage box 2. Preferably, the guiding ribs 211 and/or the guiding grooves are arranged on the top wall of the liquid storage box 2. By arranging the guiding ribs 211 and/or the guiding grooves on the top wall of the liquid storage box 2, the intelligent identification assembly 100 correspondingly provided on the corresponding insertion groove may be installed on an integrated water circuit at a top of the insertion groove, which facilitates the wiring installation of a detection circuit, simplifies the circuit, and increases safety.

More preferably, in an insertion direction of the liquid storage box 2, the guiding ribs 211 and/or the guiding grooves are arranged on a position of the top wall of the liquid storage box 2 close to a front end. The guiding ribs 211 and/or the guiding grooves are arranged on the front end of the liquid storage box 2, which can further ensure that the liquid storage box 2 can be smoothly and easily inserted into or extracted out of the insertion groove in the whole insertion and extraction process. Avoiding that the guiding ribs 211 and/or the guiding grooves and the intelligent identification assembly 100 are arranged in a middle position of the liquid storage box 2, if being set in the middle position, in the insertion and extraction process, the intelligent identification assembly 100 may interfere with the guiding ribs 211 and/or the guiding grooves, thereby affecting the smooth insertion or extraction of the liquid storage box 2 into or out of the insertion groove.

Further, the top wall of the liquid storage box 2 concaves inward to form the guiding groove, and the guiding groove has a guiding wall 2111 that can change a direction of the guiding trajectory. Specifically, the top wall of the liquid storage box 2 may be arranged to have a certain thickness, the groove formed by inward sinking of the top wall of the liquid storage box 2 forms the guiding groove, a side wall of the guiding groove forms the guiding wall 2111, and a guiding column 3312 of the intelligent identification assembly 100 abuts the guiding wall 2111, and moves along the guiding trajectory of the guiding wall 2111. The guiding identifier part 21 is formed by the above groove, which is simple to form, easy to implement, and can achieve better guiding effect.

Further, the liquid storage box 2 has at least two set identifier positions, the guiding identifier parts 21 are the guiding ribs 211 and/or the guiding grooves arranged at the identifier positions, and numbers and/or positions of the guiding ribs 211 and/or the guiding grooves arranged at the identifier positions of the liquid storage boxes 2 for different types of additives are different.

Figure 4:
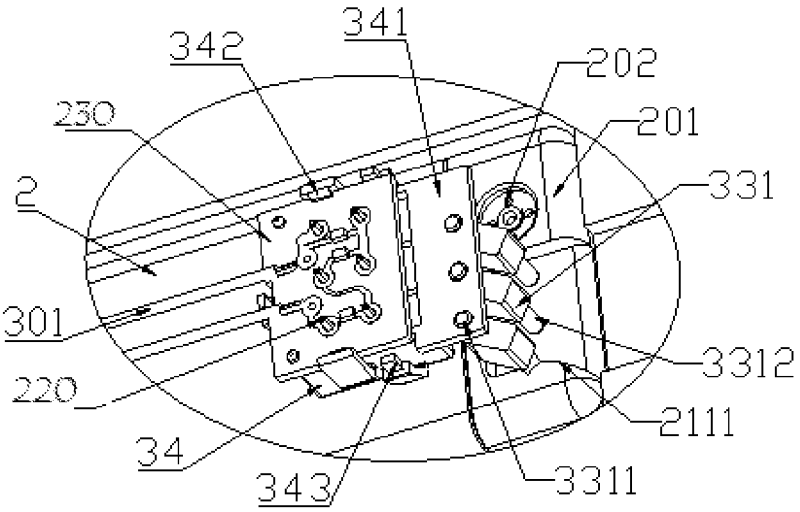
FIG. 4 is an enlarged structural diagram of a position A in FIG. 2.

In another implementation, as shown in FIG. 3 and FIG. 4, the guiding identifier part 21 may also be formed by a guiding rib 211, specifically, the top wall of the liquid storage box 2 protrudes outward to form the guiding rib 211, and the guiding rib 211 has a guiding wall 2111 that can change a direction of the guiding trajectory. A side wall of at least one side of the guiding rib 211 is the guiding wall 2111 with the changeable direction of the guiding trajectory, a side wall of one side of the guiding rib 211 is a special-shaped bent wall or an arc guiding wall 2111, so that a guiding column 3312 of the intelligent identification assembly 100 may move along the guiding wall 2111 changing a motion trajectory, so as to achieve an objective of detecting the types of the additives in the liquid storage box 2.

In another relatively preferred implementation, the guiding identifier part 21 may also adopt a structure of both the guiding groove and the guiding rib 211.

In this embodiment, a situation that the liquid storage box 2 has three identifier positions, and the guiding identifier part 21 adopts a structure of both the guiding groove and the guiding rib 211 is taken as an example for detailed description.

Specifically, as shown in FIG. 3, the identifier positions include a first identifier position Z1, a second identifier position Z2 and a third identifier position Z3 arranged at the front end of the top wall of the liquid storage box 2 side by side at intervals, a position of the top wall of the liquid storage box 2 close to the front end sinks inward to form a groove structure, and the groove structure covers the above three identifier positions.

In one implementation, the groove structure includes a groove side wall parallel to an insertion and extraction direction of the liquid storage box 2, the first identifier position Z1 is located on a groove side wall of the groove structure, and the groove side wall of one side of the groove structure is arranged to have a certain bending angle, so as to form a first guiding wall 2111 that can change a direction of a guiding trajectory. In this implementation, the groove structure may not only provide a certain avoidance space for arranging the guiding rib 211, but also utilize its own structure to form the guiding identifier part 21.

Both the second identifier position Z2 and the third identifier position Z3 are located in the groove, the guiding rib 211 may be arranged at the second identifier position Z2 or the third identifier position Z3 respectively, the guiding rib 211 includes a guiding side wall parallel to the insertion and extraction direction of the liquid storage box 2, and a side wall of one side of the guiding rib 211 is arranged to have a certain bending angle to form a second guiding wall 2111 that can change the direction of the guiding trajectory.

In another implementation, the first identifier position Z1, the second identifier position Z2 and the third identifier position Z3 may all be provided in the groove, a position where the side wall of the groove is located does not constitute the identifier position. The guiding ribs 211 are arranged at the first identifier position Z1 and/or the second identifier position Z2 and/or the third identifier position Z3 to identify the types of the additives stored in the liquid storage box 2, and any one or a combination of the number and position of the guiding ribs 211 arranged on the liquid storage box 2 correspondingly represents the types of the additives stored in the liquid storage box 2. For example, it may be set that if the guiding rib 211 is arranged at the first identifier position Z1, it represents that the type of the additives stored in the liquid storage box 2 is a detergent: if the guiding rib 211 is separately arranged at the second identifier position, it represents that the type of the additives stored in the liquid storage box 2 is a softener: if the guiding rib 211 is separately arranged at the third identifier position, it represents that the type of the additives stored in the liquid storage box 2 is a disinfectant; and if the guiding ribs 211 are arranged at the second identifier position and the third identifier position at the same time, it represents that the type of the additives stored in the liquid storage box 2 is a softener.

In the above solution, the groove structure provides an avoidance installation space for the guiding rib 211, a height of the guiding rib 211 is not larger than a depth of the groove structure, in this way, the guiding rib 211 may not protrude from the top wall of the liquid storage box 2, which effectively avoids the problem of mismatched installation between the liquid storage box 2 and the insertion groove due to the interference of the guiding rib 211.

In the above implementation, the position and number of the guiding rib 211 arranged on the liquid storage box 2 are identified by the intelligent identification assembly 100 in the insertion groove, so as to infer the type of the additives stored in the liquid storage box 2. The identification method is intelligent and efficient, the structural shape of the liquid storage box 2 is used to identify the type of the additives stored therein, without the need for other identification structures, reducing the cost and simplifying the structure of the liquid storage box 2 at the same time.

Further, in another relatively preferred implementation, as shown in FIG. 1 to FIG. 5, the liquid storage box 2 is provided with the identifier cover 201, and the guiding rib 211 and/or the guiding groove is arranged on the identifier cover 201. With the arranged identifier cover 201, processing the guiding rib 211 and/or the guiding groove on the identifier cover 201 is more convenient and easier compared to a manner of directly processing on a box body of the liquid storage box 2, and the production and manufacturing efficiency of the liquid storage box 2 is improved.

Further, the identifier cover 201 may be an independent component arranged on the top wall of the liquid storage box 2. Preferably, in this embodiment, the identifier cover 201 is a part of the liquid storage box 2, and is arranged at a position of the top wall of the liquid storage box 2 close to the front end. In this way, the identifier cover 201 may be used as a carrier for arranging the guiding rib 211 and/or the guiding groove, and also forms part of the liquid storage box 2, making it versatile and reducing the cost.

More preferably, an opening is provided in a top wall of the box body of the liquid storage box 2, and the identifier cover 201 is installed at the opening. The identifier cover 201 adopts a split structure, and is integrally assembled into the liquid storage box 2 internally provided with an independent closed cavity.

Or, the identifier cover 201 is integrally formed with the box body of the liquid storage box 2, the identifier cover 201 is integrally formed with the liquid storage box 2 by adopting a blow molding process, the process is simplified, and the manufacturing cost is reduced.

Preferably, as shown in FIG. 4, a one-way breather valve 202 is installed on the identifier cover 201 to balance a pressure difference between an interior and an exterior of the liquid storage box 2, and it is ensured that the additives in the liquid storage box 2 can be smoothly extracted. An installation hole for installing the one-way breather valve 202 is formed in the identifier cover 201, the one-way breather valve 202 is installed in the installation hole in a sealing mode, by installing the one-way breather valve 202 on the identifier cover 201 compared to a manner of arranging it at other positions of the box body of the liquid storage box 2, processing and manufacturing are convenient, and the processing process of the liquid storage box 2 is further simplified.

Embodiment 2

As shown in FIG. 1 to FIG. 6, this embodiment provides an additive dispensing apparatus 1 based on Embodiment 1. The additive dispensing apparatus 1 is provided with the insertion groove for install the liquid storage box 2 in Embodiment 1, and the insertion groove is internally provided with an intelligent identification assembly 100 for identifying the types of the additives in the liquid storage box 2 correspondingly.

As shown in FIG. 1, FIG. 2, FIG. 5 and FIG. 6, in this embodiment, the intelligent identification assembly 100 includes: a wiring terminal 220 including a first wiring terminal 311 and a second wiring terminal 312 which are connected to a detection circuit: elastic pushing members 32 including conductive elements that are in contact and electrical connection between the first wiring terminal 311 and the second wiring terminal 312 under normal conditions; and a rotating swing member 33. When the liquid storage box 2 is inserted into the insertion groove, the rotating swing member 33 may swing along the set guiding trajectory of the guiding identifier part 21 on the liquid storage box 2 and push the elastic pushing members 32 at corresponding positions to disconnect the conductive elements from the wiring terminal 220, achieving signal identification. Preferably, there are a plurality of groups of wiring terminals 220, elastic pushing members 32 and rotating swing members 33, which may cover and identify the guiding identifier parts 21 at all identifier positions on the liquid storage boxes 2 for different types of additives.

Through the above settings, after the liquid storage boxes 2 for different types of additives are inserted into the insertion groove of the additive dispensing apparatus 1 respectively, the guiding identifier parts 21 with different numbers and/or positions arranged on different liquid storage boxes 2 resist and guide the rotating swing member 33 corresponding to the intelligent identification assembly 100 arranged on the additive dispensing apparatus 1, so that the conductive elements at corresponding identifier positions are disconnected from the wiring terminal 220 corresponding thereto. Different detection signals for the wiring terminals 220 with different numbers and different positions are generated after different liquid storage boxes 2 are installed in the additive dispensing apparatus 1, so as to achieve the effects of identifying the category information of the additives represented by the guiding identifier parts 21 arranged on the liquid storage boxes 2.

Through the above method, the types of the additives in the liquid storage box 2 are determined according to the signal information of the wiring terminals 220 disconnected from the conductive elements, and the type of the liquid storage box 2 installed in the additive dispensing apparatus 1 may be accurately identified. So, it is achieved to automatically and accurately identify the types of the additives.

In this embodiment, a plurality of liquid storage boxes 2 may be placed in the insertion groove, and each liquid storage box corresponds to one intelligent identification assembly 100. Each intelligent identification assembly 100 includes wiring terminals 220, elastic pushing members 32 and rotating swing members 33. The wiring terminals 220, the elastic pushing members 32 and the rotating swing members 33 form a detection mechanism for detecting guiding identifier parts 21 at corresponding identifier positions of the liquid storage boxes 2.

In view with Embodiment 1 and FIG. 1 to FIG. 3, as an example, three identifier positions, namely a first identifier position Z1, a second identifier position Z2 and a third identifier position Z3 are arranged on the liquid storage box 2. Correspondingly the intelligent identification assembly 100 includes three groups of detection mechanisms. The intelligent identification assembly 100 includes the wiring terminals 220, the elastic pushing members 32 and the rotating swing members 33 which are arranged at the first identifier position Z1, the second identifier position Z2 and the third identifier position Z3 respectively.

If the intelligent identification assembly 100 only receives a signal which is generated by the wiring terminal 220 at the first identifier position Z1 being disconnected, it may be identified and determined that the type of the additive stored in the liquid storage box 2 is a detergent. If the intelligent identification assembly 100 only receives a signal which is generated by the wiring terminal 220 at the second identifier position Z2 being disconnected, it may be identified and determined that the type of the additives stored in the liquid storage box 2 is a conditioner. If the intelligent identification assembly 100 only receives a signal which is generated by the wiring terminal 220 at the third identifier position Z3 being disconnected, it may be identified and determined that the type of the additives stored in the liquid storage box 2 is a disinfectant. If the intelligent identification assembly 100 receives a signal which is generated by the wiring terminals 220 at the second identifier position Z2 and the third identifier position Z3 both being disconnected, it may be identified and determined that the type of the additives stored in the liquid storage box 2 is the softener.

In this embodiment, it is in detailed described taking each intelligent identification assembly 100 including three groups of detection mechanisms as an example. Each intelligent identification assembly 100 may correspondingly identify eight categories of the liquid storage boxes 2, 2*2*2=8. Of course, the number of the detection mechanisms of the intelligent identification assembly 100 is not limited, which may also be four groups, five groups or the like, and more categories of the liquid storage boxes 2 of may be identified correspondingly.

Further, as shown in FIG. 1, FIG. 2, FIG. 4 and FIG. 6, the additive dispensing apparatus 1 includes an upper cover plate 11 located at a top of the insertion groove. The rotating swing member 33 includes a swing part and an abutting part. A rotating shaft 3311 which is rotatably connected to the upper cover plate 11 is arranged on an upper end surface of the swing part, a guiding column 3312 is arranged on a lower end surface of the swing part, and the guiding column 3312 moves along the guiding trajectory of the guiding identifier part 21 to drive the swing part to swing. The abutting part is connected to the swing part at a set included angle, deflects with the swinging of the swing part, and presses the elastic pushing members to disconnect conductive elements from the wiring terminals 220.

In the above solution, a rotating shaft hole is formed in the upper cover plate 11, and the rotating shaft 3311 drives the swing part to rotate along the rotating shaft 3311 in a horizontal direction. The rotating shaft 3311 and the guiding column 3312 are not coaxially arranged, the rotating shaft 3311 and the guiding column 3312 are arranged on two sides of the swing part. The rotating shaft 3311 is arranged on a side of the swing part close to the elastic pushing member 32, and the guiding column 3312 is arranged on another side of the swing part away from the elastic pushing member 32, so that the swing part forms a cam-like structure.

Under the limitation in a vertical direction and a limitation action of the rotating shaft 3311, the swing part is guided to drive the abutting part to rotate to push the elastic pushing member 32 by the guiding column 3312, so as to disconnect the conductive elements from the wiring terminals 220, achieving signal identification. Thus, the types of the additives stored in the liquid storage box 2 are detected and identified.

Figure 6:
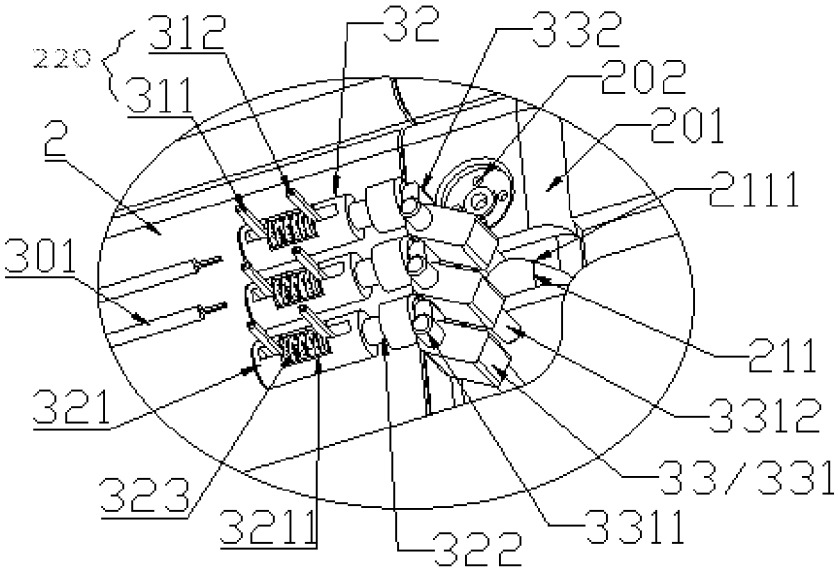
FIG. 6 is an enlarged structural diagram of a position C in FIG. 2, namely a schematic structural diagram of FIG. 5 after removing an installation seat.

Preferably, as shown in FIG. 6, the swing part is a swing block 331, and the abutting part is an abutting plate 332 connected to the side of the swing block 331 at a certain included angle. The abutting plate 332 is connected to the side wall of the swing block 331 close to the elastic pushing member 32, and an outer wall of the abutting plate 332 has an abutting plane that abuts against the elastic pushing member 32.

More preferably, the swing block 331 is integrally formed with the abutting plate 332, and an included angle between the swing block 331 and the abutting plate 332 is greater than 90°. The included angle between the swing block 331 and the abutting plate 332 is greater than 90°, so that when the swing block 331 rotates slightly, the abutting plate 332 may be driven to rotate to push the elastic pushing member 32.

Further, as shown in FIG. 1, FIG. 2, and FIG. 4 to FIG. 6, the elastic pushing member 32 includes: a barrel shell 321, fixed to the upper cover plate 11, sliding push rod, and a conductive element. An extension direction of the barrel shell 321 is parallel to the insertion and extraction direction of the liquid storage box 2. One end located outside the barrel shell 321 of the sliding push rod 322 abuts against the abutting part, and the other end is extended into the barrel shell 321 to collide with an end of the conductive element. The conductive element is movably arranged in the barrel shell 321, and two ends of the conductive element is in contact and electrical connection with the first wiring terminal 311 and the second wiring terminal 312. The rotating swing member 33 swings to drive the abutting part to deflect and press the sliding push rod 322, the sliding push rod 322 pushes the conductive element to move, so as to disconnect at least one end of the conductive element from its corresponding wiring terminal 220. Signal identification is achieved.

In one implementation, the conductive element is movably arranged in the barrel shell 321 in an axis direction of the barrel shell 321. Without an external force, the conductive element is connected between the first wiring terminal 311 and the second wiring terminal 312, and a conduction signal is generated between the first wiring terminal 311 and the second wiring terminal 312.

When a guiding rib 211 is arranged at a set identifier position of the liquid storage box 2, the rotating swing member 33 at a corresponding position moves along the guiding trajectory of the guiding rib 211 to inward push the sliding push rod 322 at the corresponding position, so as to disconnect the conductive element from the wiring terminal 220. A signal is generated by disconnecting the first wiring terminal 311 from the second wiring terminal 312. An elastic reset member is arranged in the barrel shell 321. Without a pushing force, the conductive element restores to an initial position in contact with the first wiring terminal 311 and the second wiring terminal 312 under an action of the elastic reset member.

In another preferred implementation, in this embodiment, the conductive element includes a conductive spring 323 installed in the barrel shell 321 in a limiting mode and conductive contact pieces connected with two ends of the conductive spring 323. Of course, the conductive contact pieces may also be not arranged. The wiring terminals 220 are in direct contact and connected with the two ends of the conductive spring 323. A matching effect between the wiring terminals 220 and the conductive spring 323 can be further improved through the arrangement of conductive contact pieces, and the conductive efficiency is improved.

As shown in FIG. 6, in a natural state, the conductive contact pieces at the two ends of the conductive spring 323 are in contact connection with the first wiring terminal 311 and the second wiring terminal 312 respectively. Under an action of the pushing force of the sliding push rod 322, the conductive spring 323 is compressed, and the conductive contact piece at the end of the conductive spring 323 in contact with the sliding push rod 322 is disconnected from its corresponding wiring terminal 220. Signal identification is achieved.

In the above implementation, the conductive element adopts a structure of the conductive spring 323, which can achieve a conductive action and restore to the initial state without the external force and under the action of its own spring force. There is no need to additionally arrange the elastic reset member, the structure of the elastic reset member 32 is simplified, and the cost is reduced.

Figure 5:
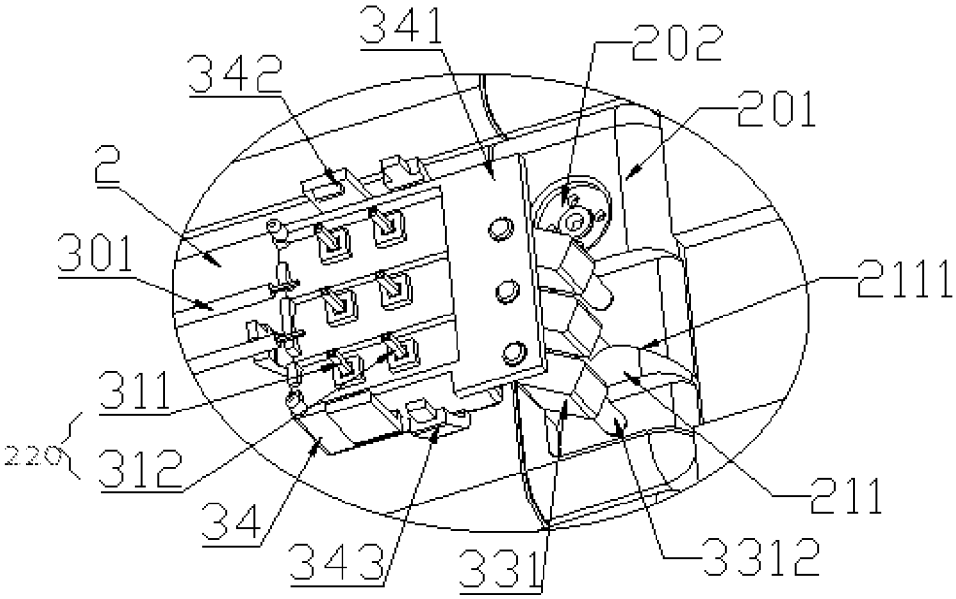
FIG. 5 is an enlarged structural diagram of a position B in FIG. 2, namely a schematic structural diagram of FIG. 4 after removing a PCB.

Specifically, in this embodiment, as shown in FIG. 5 and FIG. 6, a strip-shaped opening is formed in a circumferential wall of the top of the barrel shell 321 to form a limiting installation groove 3211 in which the conductive spring 323 is installed in a limiting mode. In an axis direction of the barrel shell 321, two ends of the conductive spring 323 abut against edges of two ends of the strip-shaped opening in a limiting mode, and the two ends of the conductive spring 323 are connected with the conductive contact pieces respectively.

Further, the sliding push rod 322 is movably arranged in the barrel shell 321 in the axis direction of the barrel shell 321. One end of the sliding push rod 322 extends out of the barrel shell 321 to abut against the abutting part, and the other end of the sliding push rod 322 abuts against the end of the conductive spring 323. Preferably, an outer diameter of the one end of the sliding push rod 322 abutting against the abutting part is expanded, so a contact area with the abutting part is increased, detachment is avoided, and a pushing effect is ensured.

Further, two ends of the limiting installation groove 3211 are further provided with ports for allowing the first wiring terminal 311 and the second wiring terminal 312 to pass through, and the first wiring terminal 311 and the second wiring terminal 312 extends into the barrel shell 321 from the ports in two sides of the limiting installation groove 3211, so as to be in contact connection with the conductive contact pieces at the two ends of the conductive spring 323.

As shown in FIG. 5 and FIG. 6, in this embodiment, the swing block 331 pushes the sliding push rod 322 to move forward and backward during swinging. Before the liquid storage box 2 is inserted, the sliding push rod 322 is not pushed, and the conductive spring 323 is in contact with the wiring terminals 220, so that three groups of detection terminals are all in a power-on state. After the liquid storage box 2 is inserted, and if the liquid storage box 2 only pushes one of the sliding push rods 322, the sliding push rod 322 drives the corresponding conductive spring 323 to move, and one end of the conductive spring 323 is compressed, so as to identify the signal generated by disconnection. Different liquid storage boxes 2 pushes different combinations of the sliding push rods 322 to move, so that different signal are input. After the liquid storage boxes 2 are pushed, the types of the additives stored therein may be intelligently identified.

Further, in this embodiment, the intelligent identification assembly 100 is fixed to the upper cover plate 11 through an installation seat 34. The installation seat 34 is internally provided with an accommodating cavity, the elastic pushing member 32 is fixedly installed in the accommodating cavity, and the barrel shell 321 is fixed into the accommodating cavity.

Further, as shown in FIG. 1, FIG. 2, FIG. 4 and FIG. 5, the installation seat 34 is fixedly connected to the upper cover plate 11 through a buckle or screw. Preferably, as shown in FIG. 1, an installation port for installing the intelligent identification assembly 100 is formed in the upper cover plate 11, a circumferential edge of the installation port extends upward to form a limiting block rib 111, and the installation seat is installed in the limiting block rib 111 in a limiting mode. A clamping platform/clamping groove is arranged on a peripheral wall of the limiting block rib 111, a clamping groove/clamping platform is correspondingly arranged on an outer peripheral wall of the installation seat 34, and the installation seat 34 is limited in the limiting block rib 111 in a clamping mode. The intelligent identification assembly 100 and the upper cover plate 11 are connected and fixed through a clamping mode, which is convenient for disassembly and replacement of the intelligent identification assembly 100. More preferably, a limiting groove formed by protruding outward is formed in the limiting block rib 111, a limiting convex rib 343 matched with the limiting groove is correspondingly arranged on the peripheral wall of the installation seat 34, and the limiting convex rib 343 is limited in the limiting groove, so as to fix the installation seat 34 in a circumferential direction. The rotation of the intelligent identification assembly 100 is avoided. Preferably, one side of the installation seat 34 close to the rotating swing member 33 is an opening, allowing the sliding push rod to extend out to be in contact with the abutting plate 332. An extension connecting wall 341 is integrally arranged at an edge of a top wall of the installation seat 34, and the rotating shaft 3311 of the rotating swing member 33 is rotatably connected to the extension connecting wall 341. Further, an avoidance opening is formed in a position of the upper cover plate 11 corresponding to the rotating swing member 33, which avoids the influence on swinging and rotation of the rotating swing member 33.

In this embodiment, one end of the wiring terminal 220 is fixed to the top wall of the installation seat 34 and connected to an external detection circuit, and the other end of the wiring terminal extends into the barrel shell 321 to be in contact connection with the conductive element. Further, the external detection circuit includes a PCB 230. All wiring terminals 220 of each intelligent identification assembly 100 are integrally arranged on the PCB 230, achieving an objective of rectification. In this way, output of signals in three circuits may be achieved with only two detection wires 301. In a case of the same actual principle, the PCB may also be not used, for example, each group of wiring terminals 220 are directly connected to the two detection wires 301. Further, as shown in FIG. 1, FIG. 2 and FIG. 4, the PCB 230 is arranged on the top wall of the installation seat 34, a plurality of clamping jaws 342 are arranged on the peripheral wall of the installation seat 34, and the clamping jaws 342 are clamped on the PCB 230 to limit and fix the PCB 230. So, it is avoided that the PCB 230 moves and displaces, affecting the accuracy of detection results.

This embodiment further provides an identification method with the above additive dispensing apparatus, including: a liquid storage box 2 being inserted into an insertion groove of the additive dispensing apparatus: a guiding identifier part 21 on the liquid storage box 2 resisting to guide a corresponding rotating swing member 33 in the insertion groove, so that conductive elements at corresponding identifier positions is disconnected from their corresponding wiring terminals 220; and acquiring signal information of the wiring terminals 220 disconnected from each conductive element, and determining types of additives in the liquid storage box 2 based on the signal information of the wiring terminals 220 disconnected from each conductive element. Through the above method, the types of the additives in the liquid storage box 2 are determined according to the signal information of the wiring terminals 220 disconnected from each conductive element. The liquid storage box 2 installed in the additive dispensing apparatus is accurately identified, so that the types of the additives is automatically and accurately identified.

Embodiment 3

As shown in FIG. 7 to FIG. 17, the embodiment of the present disclosure provides a dispensing apparatus. The dispensing apparatus at least includes a box body 2104. The box body 2104 has at least one insertion groove, and a liquid storage box 2 is installed in the insertion groove. A dispensing port is formed in the liquid storage box 2, and a sealing cover 2001 of the liquid storage box 2 is installed at the dispensing port of the liquid storage box 2. The dispensing apparatus further includes a dispensing unit 2100, and the dispensing unit 2100 communicates with an interior of the liquid storage box 2 through the sealing cover 2001. The sealing cover 2001 is installed at the dispensing port of the liquid storage box 2. The dispensing port is closed under normal conditions to form a closed cavity 2103 for storing additives in the liquid storage box 2. An identification apparatus for identifying categories and/or the remaining quantities of the additives in the liquid storage box 2 is arranged on the sealing cover 2001.

As a preferred solution of the sealing cover 2001, the sealing cover 2001 includes a connecting sleeve, of which an outlet end is located at the dispensing port of the liquid storage box 2, and an inlet end is extended into the liquid storage box 2. A flow guide channel 2013 is formed in the connecting sleeve. The sealing cover 2001 further includes a clamping end cap 2011 connected to the outlet end of the connecting sleeve and installed at the dispensing port in a sealing mode, and the conductive contact pieces 2015 are arranged on the clamping end cap 2011.

In order that the type or remaining quantity of the additives in the liquid storage box 2 is detected, generally an identification or detection apparatus is directly arranged on the liquid storage box 2. In the following embodiment, the identification or detection apparatus is arranged on the sealing cover 2001, so as to identify or detect the type or remaining quantity of the additives in the liquid storage box 2.

Specifically, as shown in FIGS. 7-13, the identification apparatus includes at least two conductive contact pieces 2015 arranged on the sealing cover 2001 and being in contact with the additive in the liquid storage box 2. Any one or a combination of the number and position of the conductive contact pieces 2015 arranged on the sealing cover 2001 correspondingly represents the type of the additives stored in the liquid storage box 2.

Further, a first conductive contact piece 2015 and a second conductive contact piece 2015 which are spaced at an interval are arranged on the sealing cover 2001, and the interval correspondingly represents the type of the additive stored in the liquid storage box 2. Preferably, the interval information includes distance information, relative spatial orientation information and position information arranged on the liquid storage box 2 between the first conductive contact pieces 2015 and the second conductive contact pieces 2015.

As shown in FIGS. 10-13, further, the identification apparatus further includes conductive probes 103 arranged on the sealing cover 2001 and extending into the closed cavity 2103. The conductive contact pieces 2015 exposed on an outer wall surface of the sealing cover 2001 are connected with the conductive probes 103, and the conductive contact pieces 2015 are conducted with the additive in the closed cavity 2103 through the conductive probes 103.

Preferably, one ends of the conductive probes 103 are connected to the sealing cover 2001, and the other ends of the conductive probes 103 extend into the closed cavity 2103. The ends of the conductive probes 103 connected to the sealing cover 2001 are as the conductive contact pieces 2015. Alternatively, contact pieces independently arranged on the sealing cover 2001 and being in contact with the conductive probes 103 form the conductive contact pieces 2015. The conductive contact pieces 2015 are arranged on the clamping end cap 2011. Preferably, one ends of the conductive probes 103 are connected to the conductive contact pieces 2015, and the other ends of the conductive probes 103 extend into the connecting sleeve. Alternatively, one ends of the conductive probes 103 are connected to the conductive contact pieces 2015, and the other ends of the conductive probes 103 are in the liquid storage box 2. More preferably, the conductive probes 103 are embedded into a wall of the connecting sleeve, and the conductive contact pieces 2015 are exposed outside the clamping end cap 2011. The conductive contact pieces 2015 protrude from an outer wall surface of the clamping end cap 2011, or are embedded into an outer wall of the clamping end cap 2011.

It should be understood that the conductive contact pieces 2015 can identify or detect the type of the additive stored in the liquid storage box 2, wherein the conductive probes 103 play a role in conduction or information transmission as "media" or "intermediates". The conductive probes 103 do not play any other role in this embodiment.

Figure 7:
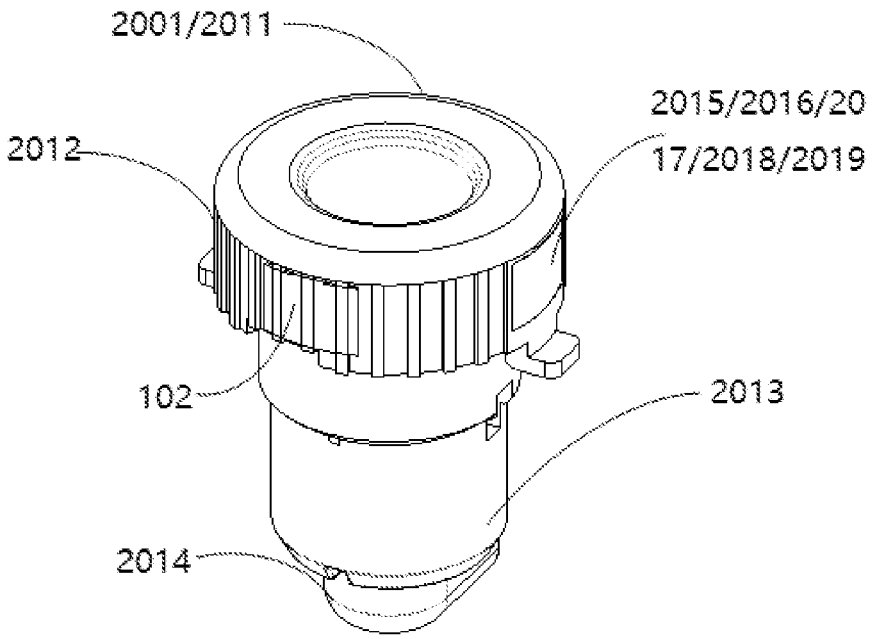
FIG. 7 is a first schematic structural diagram of a sealing cover of a liquid storage box in an embodiment of the present disclosure.
Figure 8:
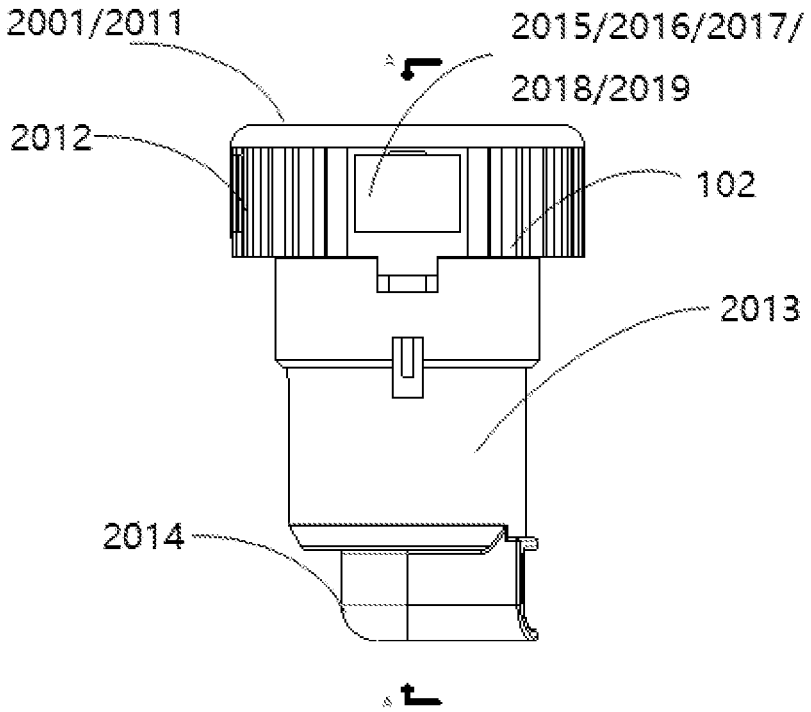
FIG. 8 is a second schematic structural diagram of a sealing cover of a liquid storage box in an embodiment of the present disclosure.
Figure 9:
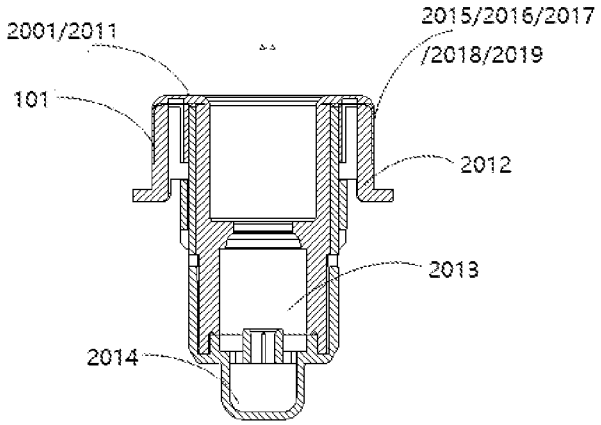
FIG. 9 is a schematic cross-sectional view of A-A in FIG. 8 in an embodiment of the present disclosure.
Figure 10:
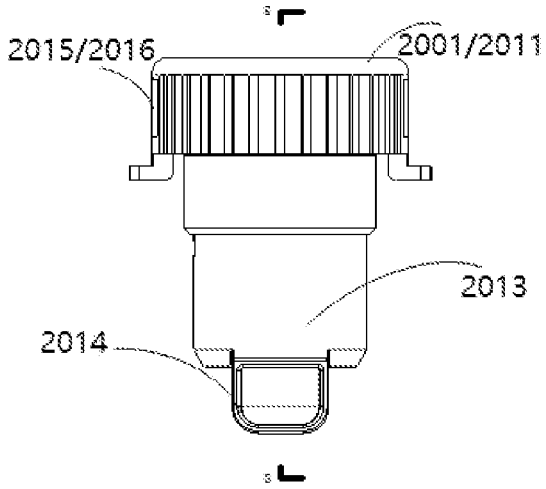
FIG. 10 is a third schematic structural diagram of a sealing cover of a liquid storage box in an embodiment of the present disclosure.
Figure 11:
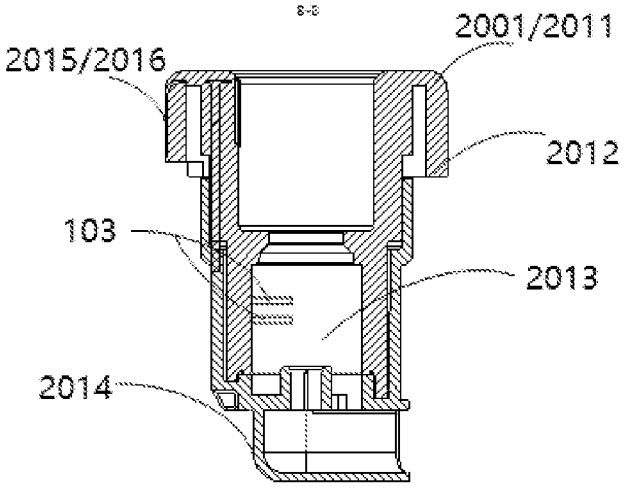
FIG. 11 is a first schematic cross-sectional view of B-B in FIG. 10 in an embodiment of the present disclosure.
Figure 12:
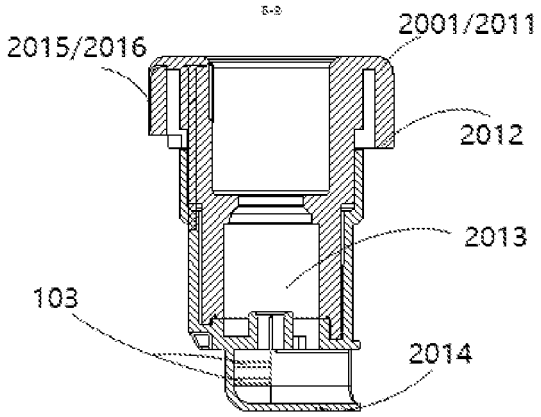
FIG. 12 is a second schematic cross-sectional view of B-B in FIG. 10 in an embodiment of the present disclosure.
Figure 13:
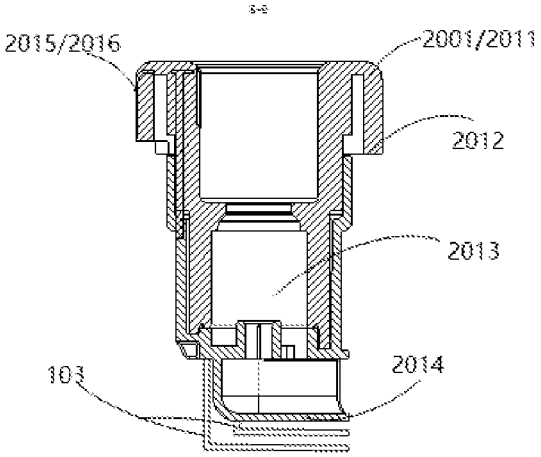
FIG. 13 is a third schematic cross-sectional view of B-B in FIG. 10 in an embodiment of the present disclosure.

As shown in FIGS. 7-9, the identification apparatus further includes at least one photosensitive component arranged on the sealing cover 2001. Any one or a combination of the number, position and transmittance of the photosensitive component correspondingly represents the type of the additive stored in the liquid storage box 2.

As shown in FIGS. 15-18, preferably, the photosensitive component is one or more light blocking parts arranged on the sealing cover 2001. Any one or any combination selected from a group consisting of the number, position, thickness, material and color of the light blocking parts arranged on the sealing cover 2001 correspondingly represents the type of the additive stored in the liquid storage box 2. More preferably, the light blocking parts have multiple arrangements and combinations according to different positions and numbers of the light blocking parts arranged on the sealing cover 2001, and the light blocking parts with different arrangements and combinations correspondingly represent different types of the additives stored in the liquid storage box 2.

As shown in FIGS. 7-9, the identification apparatus further includes crystal oscillators which are arranged in the sealing cover 2001 and may generate different frequencies. The crystal oscillators with different frequencies correspond to different parameter information of the additives contained in the liquid storage box 2, and the parameter information at least includes the type information of the additives. Preferably, the crystal oscillator includes, a crystal oscillator which is arranged in the sealing cover 2001 and may generate different frequency, and a first contact and a second contact connected to two ends of the crystal oscillator respectively. The first contact and the second contact are used for electrical connection between the crystal oscillator and an external circuit. The identification apparatus includes at least one concave-convex part 2017 arranged on an outer wall of the sealing cover 2001. A combination of the number and position of the concave-convex part 2017 arranged on the sealing cover 2001 correspondingly represents the type of the additive stored in the liquid storage box 2.

As shown in FIGS. 15-18, preferably, a first concave-convex part 2017 and a second concave-convex part 2017 which are spaced at an interval are arranged on the sealing cover 2001, and the interval correspondingly represents the type of the additive stored in the liquid storage box 2. More preferably, the interval includes distance information, relative spatial orientation information and position information arranged on the sealing cover 2001 between the first concave-convex part 2017 and the second concave-convex part 2017.

A clothing treatment device is provided with the above dispensing apparatus. the additive is automatically dispensed through the dispensing apparatus.

As shown in FIGS. 7-18, this embodiment provides an additive dispensing apparatus, having three insertion grooves, and three liquid storage boxes 2 are installed in the insertion grooves. Any one of the liquid storage boxes 2 is provided with a dispensing port, and a sealing cover 2001 is installed at the dispensing port of the liquid storage box 2. The additive dispensing apparatus further includes a dispensing unit 2100, and the dispensing unit 2100 communicates with interiors of the liquid storage boxes 2 through the sealing cover 2001. The sealing cover 2001 is installed at the dispensing port of the liquid storage box 2. The dispensing port is closed under normal conditions to form a closed cavity 2103 for storing the additives in the liquid storage box 2. An identification apparatus for identifying the type of the additive in the liquid storage box 2 is arranged on the sealing cover 2001. The sealing cover 2001 includes: a connecting sleeve, of which an outlet end is located at the dispensing port of the liquid storage box 2, an inlet end is extended into the liquid storage box 2. The connecting sleeve is internally provided with a flow guide channel 2013. The sealing cover 2001 further includes a clamping end cap 2011 connected to the outlet end of the connecting sleeve and installed at the dispensing port in a sealing mode, and the conductive contact pieces 2015 are arranged on the clamping end cap 2011.

As shown in FIGS. 7-9, the identification apparatus includes two conductive contact pieces 2015 arranged on the sealing cover 2001 and being in contact with the additive in the liquid storage box 2. Any one or a combination of the number and position of the conductive contact pieces 2015 arranged on the sealing cover 2001 correspondingly represents the type of the additive stored in the liquid storage box 2. Further, a first conductive contact piece 2015 and a second conductive contact piece 2015 which are spaced at different intervals are arranged on the sealing cover 2001, and the interval correspondingly represents the type of the additive stored in the liquid storage box 2. Preferably, the interval information includes distance information, relative spatial orientation information and position information arranged on the liquid storage box 2 between the first conductive contact piece 2015 and the second conductive contact piece 2015. Further, the identification apparatus further includes conductive probes 103 arranged on the sealing cover 2001 and extending into the closed cavity 2103. The conductive contact pieces 2015 exposed on an outer wall surface of the sealing cover 2001 are connected with the conductive probes 103, and the conductive contact pieces 2015 are conducted with the additive in the closed cavity 2103 through the conductive probes 103. Preferably, one ends of the conductive probes 103 are connected to the sealing cover 2001, and the other ends of the conductive probes 103 extend into the closed cavity 2103. The ends of the conductive probes 103 connected to the sealing cover 2001 are as the conductive contact pieces 2015. Alternatively, contact pieces independently arranged on the sealing cover 2001 and being in contact with the conductive probes 103 form the conductive contact pieces 2015. The conductive contact pieces 2015 are arranged on the clamping end cap 2011.

As shown in FIGS. 10-18, preferably, one ends of the conductive probes 103 are connected to the conductive contact pieces 2015, and the other ends of the conductive probes 103 extend into the connecting sleeve. Alternatively, one ends of the conductive probes 103 are connected to the conductive contact pieces 2015, and the other ends of the conductive probes 103 are extended in the liquid storage box 2. More preferably, the conductive probes 103 are embedded into a wall of the connecting sleeve, and the conductive contact pieces 2015 are exposed outside the clamping end cap 2011. The conductive contact pieces 2015 protrude from an outer wall surface of the clamping end cap 2011, or are embedded into an outer wall of the clamping end cap 2011.

It should be understood that the conductive contact pieces 2015 can identify or detect the types of the additive stored in the liquid storage box 2, wherein the conductive probes 103 play a role in conduction or information transmission as "media" or "intermediates", and the conductive probes 103 do not play a role in detecting a liquid level or state in this embodiment. It should be understood that the conductive probes 103 only need to be arranged on the sealing cover 2001, and the specific position setting needs to be determined in combination with the detection method and specific structures of designed components, which is not limited here.

As shown in FIGS. 7-14, an end of an outer side of the clamping end cap 2011 extends outward by a certain distance in a peripheral direction and then reversely bends to form a turnover clamping wall 2012, and the conductive contact pieces 2015 are arranged on an outer side wall of the turnover clamping wall 2012. Specifically, the connecting sleeve further includes a directional liquid inlet pipeline 2014, and the directional liquid inlet pipeline 2014 is connected with the flow guide channel 2013. A port of the directional liquid inlet pipeline 2014 faces a bottom wall of the liquid storage box 2 and is close to the bottom wall of the liquid storage box 2. The additive in the liquid storage box 2 is discharged out of the liquid storage box 2 sequentially through the directional liquid inlet pipeline 2014, the flow guide channel 2013 and the dispensing port. The conductive probes 103 are embedded into an inner wall of the connecting sleeve or the directional liquid inlet pipeline 2014, a wire is arranged in the wall, and the conductive probes 103 are electrically connected with the conductive contact pieces 2015 through the wire. At the same time, the conductive contact pieces 2015 arranged on the turnover clamping wall 2012 are connected with an external line 2101, so that it is transmitted to a control system or other upstream and downstream systems, units, etc.

It should be understood that the positions of the conductive probes 103 at the sealing cover 2001 are not limited to be located on the liquid inlet pipeline. It may be any position setting through which t the detection method can be implemented. Similarly, the positions of the conductive contact pieces 2015 are not limited to be located on the turnover clamping wall 2012. It may be any position setting through which t the detection method can be implemented, which is not limited here.

Embodiment 4

As shown in FIGS. 7-9 and 14-17, this embodiment provides an additive dispensing apparatus, having four insertion grooves, and four liquid storage boxes 2 are installed in the insertion grooves. Any one of the liquid storage boxes 2 is provided with a dispensing port, and a sealing cover 2001 is installed at the dispensing port of the liquid storage box 2. The additive dispensing apparatus further includes a dispensing unit 2100, and the dispensing unit 2100 communicates with an interior of the liquid storage box 2 through the sealing cover 2001. The identification apparatus may further be at least one photosensitive component arranged on the sealing cover 2001. Any one or any combination of the number, position and transmittance of the photosensitive component correspondingly represents the type of the additive stored in the liquid storage box 2. Preferably, the photosensitive component is one or more light blocking parts arranged on the sealing cover 2001. Any one or any combination selected from a group consisting of the number, position, thickness, material and color of the light blocking parts arranged on the sealing cover 2001 correspondingly represents the type of the additive stored in the liquid storage box 2. More preferably, the light blocking parts have multiple arrangements and combinations according to different positions and numbers of the light blocking parts arranged on the sealing cover 2001, and the light blocking parts with different arrangements and combinations correspondingly represent different types of the additives stored in the liquid storage box 2.

Figure 14:
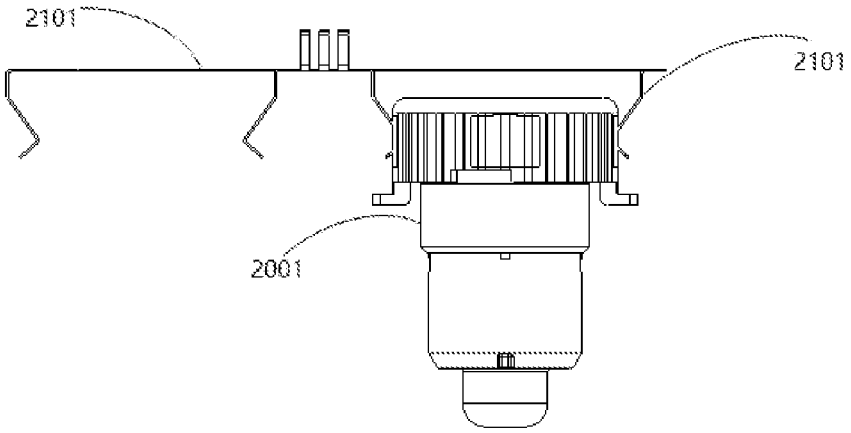
FIG. 14 is a first partial schematic structural diagram of a dispensing apparatus in an embodiment of the present disclosure.
Figure 15:
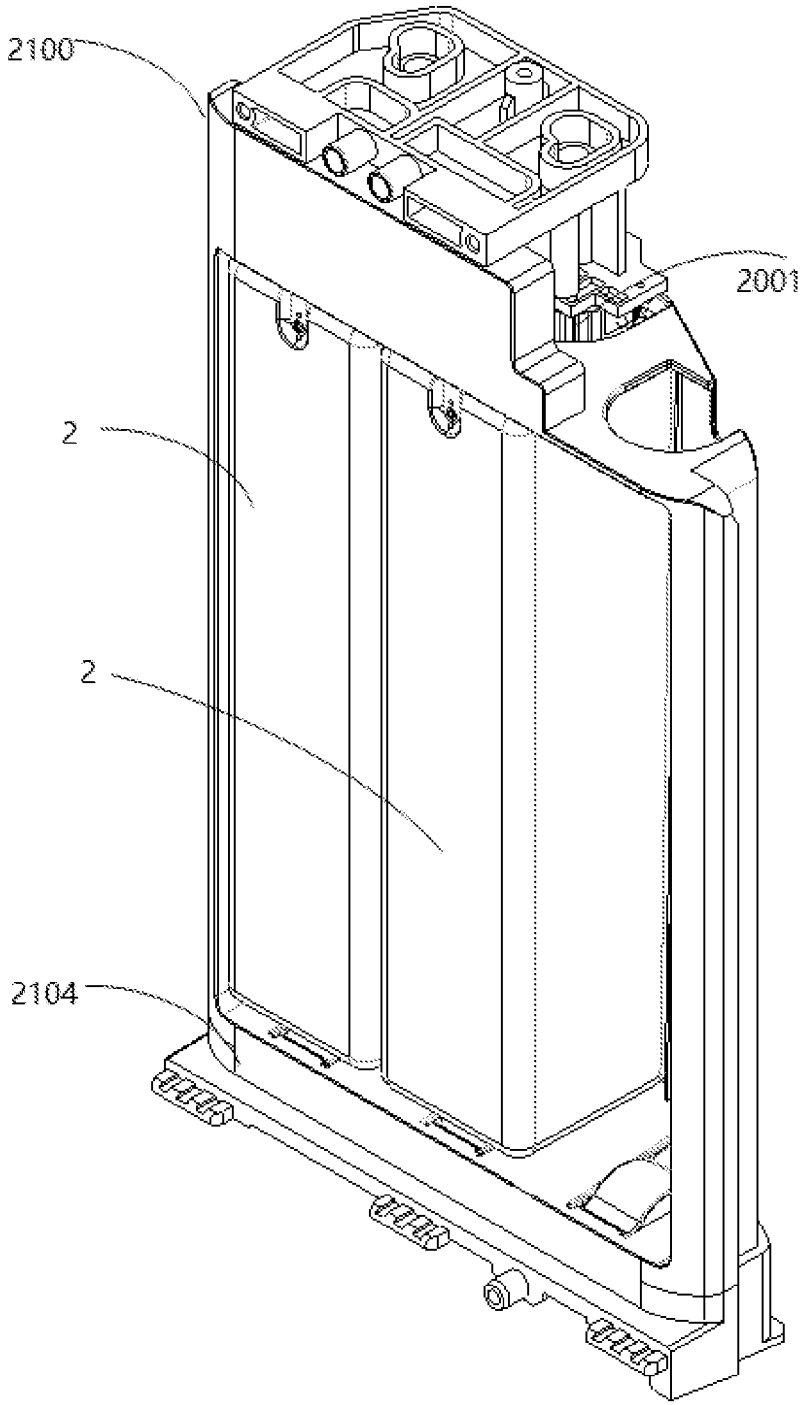
FIG. 15 is a second partial schematic structural diagram of a dispensing apparatus in an embodiment of the present disclosure.
Figure 16:
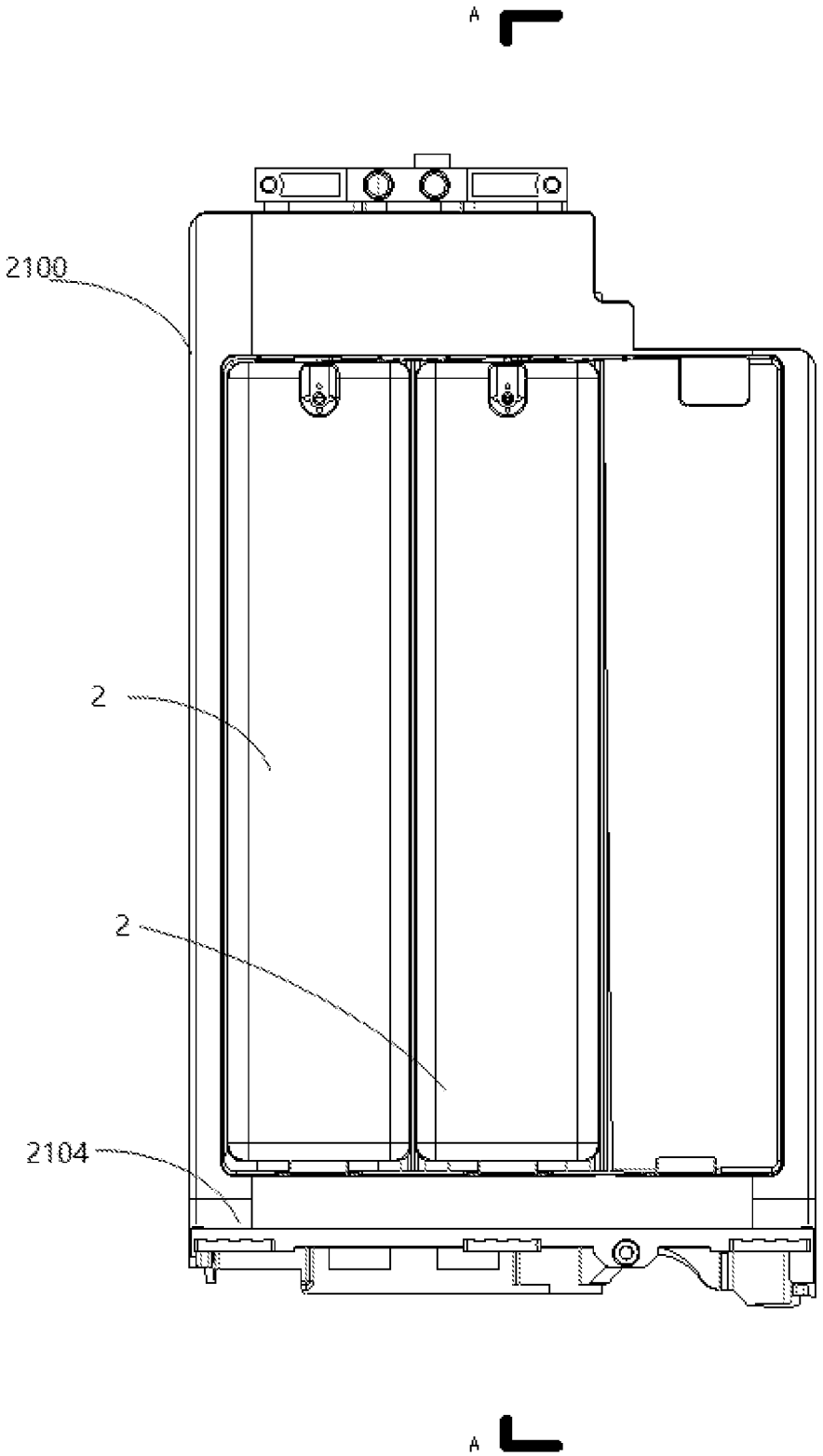
FIG. 16 is a third partial schematic structural diagram of a dispensing apparatus in an embodiment of the present disclosure.
Figure 17:
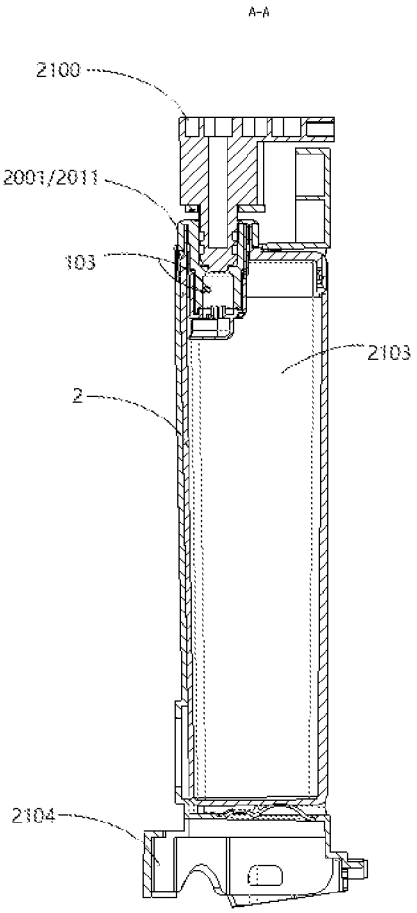
FIG. 17 is a first schematic cross-sectional view of A-A in FIG. 12 in an embodiment of the present disclosure.
Figure 18:
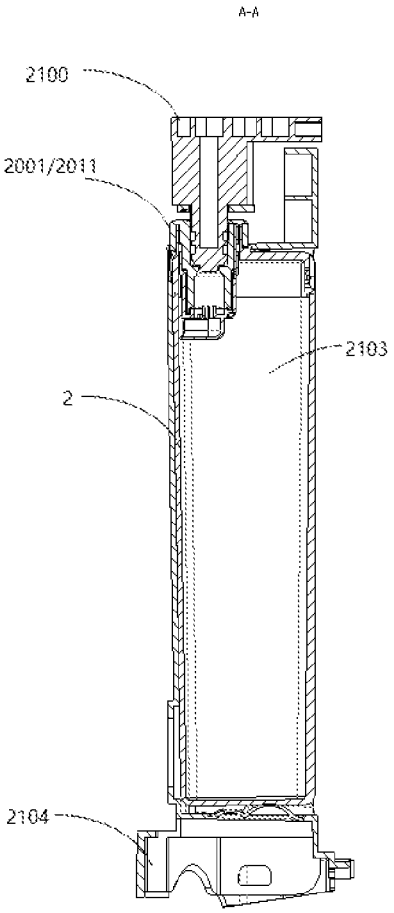
FIG. 18 is a second schematic cross-sectional view of A-A in FIG. 12 in an embodiment of the present disclosure.

As shown in FIG. 14, the light blocking parts are a plurality of light blocking protrusions 102 protruding outward from the outer wall of the turnover clamping wall 2012. The light blocking protrusions 102 are distributed around the turnover clamping wall 2012. Different numbers and/or positions of the arranged light blocking protrusions 102 represent different types of additives. The photosensitive components have reflective surfaces. Any one or any combination selected from a group consisting of the number, position and reflectivity of the photosensitive components arranged on the turnover clamping wall 2012 correspondingly represents the type of the additive stored in the liquid storage box 2. Alternatively, the photosensitive components are identification labels with different colors arranged on the outer wall of the turnover clamping wall 2012, the light reflectivity of the identification labels with different colors is different, and different colors of the identification labels arranged on the turnover clamping wall 2012 correspondingly represent different types of the additives stored in the liquid storage box 2. The dispensing apparatus is provided with a box body 2104 for containing the liquid storage box 2. The box body 2104 is provided with a plurality of optical detection mechanisms, and all the optical detection mechanisms cover irradiation and identification positions corresponding to the photosensitive components arranged on the sealing cover 2001. All the photosensitive components arranged on the sealing cover 2001 are irradiated and identified by the optical detection mechanisms arranged at corresponding irradiation and identification positions on the box body 2104 respectively.

Preferably, as shown in FIGS. 14-21, the optical detection mechanisms are arranged at positions close to the clamping end cap 2011 or the turnover clamping wall 2012. The position is a part of the box body 2104, as an annular end cap. The optical detection mechanisms include light emitting parts and light receiving parts arranged on the annular end cap, and the light emitting parts and the light receiving parts are in one-to-one correspondence with the positions of the light blocking parts. It should be noted that the annular end cap is not shown in the figures. The liquid storage box 2 and the sealing cover 2001 have good transmittance. After the liquid storage box 2 with different sealing covers 2001 is installed in the box body 2104, the light blocking parts arranged on the turnover clamping wall 2012 block light beams emitted by the light emitting parts at the corresponding positions from passing through, and the light receiving parts correspondingly receive light beams with different combinations, different light intensities or preset light intensities. The photosensitive components have reflective surfaces, or the photosensitive components are identification labels with different colors arranged on the outer wall of the turnover clamping wall 2012. The optical detection mechanisms are arranged on the annular end cap.

The light emitting parts and the light receiving parts are in one-to-one correspondence with the photosensitive components. The light receiving parts may receive light beams reflected by the photosensitive components at the corresponding positions. After the liquid storage box 2 with the sealing cover 2001 is installed in the box body 2104, the photosensitive components on the turnover clamping wall 2012 reflect the light beams to the light receiving parts at corresponding positions. Preferably, the dispensing apparatus further includes an identification unit, and the identification unit determines the type of the additive in the liquid storage box 2 based on information of the reflected light beams received by all light receiving parts.

It should be understood that the positions of the photosensitive components at the sealing cover 2001 are not limited to the turnover clamping wall 2012. It can be any position setting that can implement the detection method. Similarly, the positions of the optical detection mechanisms are not limited to the annular end cap, and it can be any position setting that can implement the detection method, which is not limited here.

Embodiment 5

As shown in FIGS. 7-9 and 14-17, this embodiment provides an additive dispensing apparatus, having five insertion grooves, and five liquid storage boxes 2 are installed in the insertion grooves. Any one of the liquid storage boxes 2 is provided with a dispensing port, and a sealing cover 2001 is installed at the dispensing port of the liquid storage box 2. The additive dispensing apparatus further includes a dispensing unit 2100, and the dispensing unit 2100 communicates with an interior of the liquid storage box 2 through the sealing cover 2001. The identification apparatus further includes at least one concave-convex part 2017 arranged on an outer wall of the sealing cover 2001, and a combination of the number and position of the concave-convex part 2017 arranged on the sealing cover 2001 correspondingly represents the type of the additive stored in the liquid storage box 2. Preferably, a first concave-convex part 2017 and a second concave-convex part 2017 which are spaced at an interval are arranged on the sealing cover 2001, and the interval correspondingly represents the type of the additive stored in the liquid storage box 2. More preferably, the interval includes distance information, relative spatial orientation information and position information arranged on the sealing cover 2001 between the first concave-convex part 2017 and the second concave-convex part 2017.

As shown in FIGS. 14-21, the concave-convex parts 2017 are protrusions protruding outward from the outer wall of the clamping end cap 2011 or the turnover clamping wall 2012, or are grooves sinking inward from the outer wall of the clamping end cap 2011 or the turnover clamping wall 2012. Preferably, the concave-convex parts 2017 are directly formed by the outer wall of the clamping end cap 2011 or the turnover clamping wall 2012. Alternatively, the concave-convex parts 2017 are formed by independent components installed on the outer wall of the clamping end cap 2011 or the turnover clamping wall 2012. Preferably, all concave-convex parts 2017 have the same shape. Contact switches are arranged on the annular end cap, all contact switches cover the corresponding contact positions where being contact with the concave-convex parts 2017 arranged on the outer walls of different clamping end caps 2011 or the turnover clamping wall 2012. Each concave-convex part 2017 arranged on the outer wall of the clamping end cap 2011 or the turnover clamping wall 2012 is in contact with one contact switch arranged in the annular end cap. The dispensing apparatus further includes an identification unit for determining the type of the additive in the liquid storage box 2 based on information of the contact switches in contact with the concave-convex parts 2017. Preferably, the information of the contact switches in contact with the concave-convex parts 2017 includes any one or a combination of the number and position of the contact switches in contact with the concave-convex parts 2017. There are five sealing covers 2001, and there are also at least five annular end caps. All the annular end caps are divided into a plurality of types according to different types of additives that can be dispensed, and any one or a combination of the number and position of the contact switches arranged in the different types of annular end caps is different from the others.

It should be understood that the positions of the concave-convex parts 2017 at the sealing cover 2001 are not limited to the clamping end cap 2011 or the turnover clamping wall 2012, and it may be any position setting that can implement the detection method. Similarly, the positions of the contact switches are not limited to the annular end cap, and it may be any position setting that can implement the detection method, which is not limited here.

Embodiment 6

As shown in FIGS. 7-9 and 14-17, this embodiment provides a dispensing apparatus, having two insertion grooves, and two liquid storage boxes 2 are installed in the insertion grooves. Any one of the liquid storage boxes 2 is provided with a dispensing port, and a sealing cover 2001 is installed at the dispensing port of the liquid storage box 2. The additive dispensing apparatus further includes a dispensing unit 2100, and the dispensing unit 2100 communicates with an interior of the liquid storage box 2 through the sealing cover 2001. The identification apparatus further includes crystal oscillators which are arranged in the sealing cover 2001 and may generate different frequencies. The crystal oscillators with different frequencies correspond to different parameter information of the additives contained in the liquid storage box 2, and the parameter information at least includes the type information of the additives. Preferably, the crystal oscillator includes a crystal oscillator which is arranged in the sealing cover 2001 and may generate different frequency, and a first contact and a second contact connected to two ends of the crystal oscillator respectively. The first contact and the second contact are used for electrical connection between the crystal oscillator and an external circuit. The first contact is connected to one end of the crystal oscillator through a first lead, and the second contact is connected to the other end of the crystal oscillator through a second lead.

As shown in FIGS. 7-9, the first contact and the second contact are arranged an inner wall of the connecting sleeve, the first contact is connected with the third contact 2018 arranged on the turnover clamping wall 2012 through an internal wire. The second contact is connected to the fourth contact 101 arranged on the turnover clamping wall 2012 through another internal wire. The internal wire is arranged in the inner wall of the connecting sleeve. The dispensing apparatus is internally provided with a crystal oscillator detection line by which frequency information of the crystal oscillators may be detected to obtain parameter information of the additive in the liquid storage box. The parameter information at least includes type information of the additive. The crystal oscillator detection line at least includes a first transmission line and a second transmission line, the first transmission line is connected with the third contact 2018, and the second transmission line is connected with the fourth contacts 101. When the third contacts 2018 and the fourth contacts 101 are conducted with the crystal oscillator detection line, a detection loop between the crystal oscillator detection line and the crystal oscillators is conducted, and it is detected whether there is the crystal oscillator with a preset frequency in the liquid storage box through the crystal oscillator detection line.

It should be understood that the crystal oscillator is arranged in the sealing cover 2001. Based on the specific structure of the sealing cover 2001, the external line 2101 can transmit signals with different frequencies to the outside and be electrically connected with a corresponding receiving and processing unit. That is, any design that can achieve the detection method based on the sealing cover 2001 belongs to the protection scope of this embodiment.

Embodiment 7

As shown in FIGS. 7-18, this embodiment provides an additive dispensing apparatus, having six insertion grooves, and six liquid storage boxes 2 are installed in the insertion grooves. Any one of the liquid storage boxes 2 is provided with a dispensing port, and a sealing cover 2001 is installed at the dispensing port of the liquid storage box 2. The additive dispensing apparatus further includes a dispensing unit 2100, and the dispensing unit 2100 communicates with interiors of the liquid storage boxes 2 through the sealing cover 2001. The identification apparatus may further be a conductive detection part which is arranged on the sealing cover 2001 and can detect liquid level information of the additive. The conductive detection part and the sealing cover 2001 are of an integrated structure. Alternatively, the conductive detection part is a partial structure of the sealing cover 2001, and a part of a box body of the sealing cover 2001 is made of a conductive material to form the conductive detection part. The conductive detection part is at least two conductive probes 103 integrally formed in the sealing cover 2001. One ends of the conductive probes 103 are liquid level detection ends for detecting a liquid level, and the other ends of the conductive probes are provided with conductive components 2016 being in contact and electrical connection with an external circuit. The liquid level detection ends are located in the liquid storage box 2 or the connecting sleeve. The conductive components 2016 are exposed outside the sealing cover 2001, and the conductive components 2016 protrude from an outer wall surface of the sealing cover 2001 or embedded into a body of the sealing cover 2001.

Preferably, the conductive probes 103 are embedded into a sleeve wall of the connecting sleeve, and the conductive components 2016 are exposed outside the clamping end cap 2011. The conductive contact pieces 2015 protrude from an outer wall surface of the clamping end cap 2011, or are embedded into an outer wall of the clamping end cap 2011. An outer sidewall of the clamping end cap 2011 extends outward by a certain distance in a peripheral direction and then reversely bends to form a turnover clamping wall 2012, and the conductive components 2016 are arranged on an outer wall of the turnover clamping wall 2012.

Specifically, the connecting sleeve further includes a directional liquid inlet pipeline 2014, and the directional liquid inlet pipeline 2014 is connected with the flow guide channel 2013. A port of the directional liquid inlet pipeline 2014 faces a bottom wall of the liquid storage box 2 and is close to the bottom wall of the liquid storage box 2. The additive in the liquid storage box 2 is discharged out of the liquid storage box 2 sequentially through the directional liquid inlet pipeline 2014, the flow guide channel 2013 and the dispensing port. The conductive probes 103 are embedded into an inner wall of the connecting sleeve or the directional liquid inlet pipeline 2014, a wire is arranged in the wall, and the conductive probes 103 are electrically connected with the conductive components 2016 through the wire. At the same time, the conductive components 2016 arranged on the turnover clamping wall 2012 are connected with an external line 2101, so that it is transmitted to a control system or other upstream and downstream systems, units, etc.

It should be understood, in this embodiment, the conductive probes 103 are used for detecting the liquid level of the additive, and the conductive components 2016 do not involve identification of the type of the additive.

Preferably, the conductive probes 103 are arranged at intervals, and the liquid level detection ends of the conductive probes 103 extend toward a bottom of the liquid storage box 2 and are higher than a bottom wall of the liquid storage box 2. The conductive probes 103 and the sealing cover 2001 are of an integrated structure formed by a melting, hot-pressing, hot-riveting and/or bonding process.

A liquid level detection module is arranged on the dispensing apparatus. When the liquid storage box 2 having the conductive detection part of the sealing cover 2001 is placed into the dispensing apparatus, the liquid level detection module is in contact and electrical connection with the conductive detection part, and liquid level information of the additive in the liquid storage box 2 is judged through a feedback signal outputted by the liquid level detection module. The liquid level detection module at least includes an external line 2101.

It should be understood that the positions of the conductive probes 103 at the sealing cover 2001 are not limited to be located on the liquid inlet pipeline. It may be any position setting through which the detection method can be implemented. Similarly, the positions of the conductive components 2016 are not limited to be located on the turnover clamping wall 2012. It may be any position setting through which the detection method can be implemented, which is not limited here.

Embodiment 8

As shown in FIGS. 7-9 and 14-17, this embodiment provides an additive dispensing apparatus, having a plurality of insertion grooves, and a plurality of liquid storage boxes 2 are installed in the insertion grooves. Any one of the liquid storage boxes 2 is provided with a dispensing port, and a sealing cover 2001 is installed at the dispensing port of the liquid storage box 2. The additive dispensing apparatus further includes a dispensing unit 2100, and the dispensing unit 2100 communicates with an interior of the liquid storage box 2 through the sealing cover 2001. The identification apparatus may further be an electronic label 2019 arranged on the sealing cover 2001. The dispensing apparatus may obtain parameter information of the additive in a liquid storage box by reading the electronic label 2019, and control its own dispensing state according to the obtained parameter information of the additive in the liquid storage box. The electronic label 2019 is an NFC label attached to an outer wall/inner wall of the sealing cover 2001. The dispensing apparatus further includes a reading module for analyzing and reading the NFC label. The reading module may obtain the parameter information of the additive in the liquid storage box by identifying the NFC label, and feedback the parameter information to a main control board of the dispensing apparatus, and the main control board may control locking/unlocking of the dispensing unit 2100 of the dispensing apparatus according to the received feedback information.

It should be understood that the position of the electronic label 2019 at the sealing cover 2001 is not limited to be located on the outer wall/inner wall. It may be any position setting through which the detection method can be implemented. Similarly, the position of the reading module is not specifically limited, and it may be any position setting through which the detection method can be implemented, which is not limited here.

Embodiment 9

As shown in FIGS. 7-18, the combination of Embodiment 1 and Embodiment 5 may simultaneously detect the type and remaining quantity information of the additive in the liquid storage box 2, and please refer to Embodiment 1 and Embodiment 5 for specific details.

It should be understood that the identification apparatus for identifying the type and/or remaining quantities of the additive in the liquid storage box 2 is not limited to the methods or apparatuses in the above embodiments, and may further be any other existing or future developed methods or technologies, which is not limited here.

Embodiment 10

A clothing treatment device is provided with any one or a combination of the above dispensing apparatuses in Embodiments 1 to 7. The additive is automatically dispensed through the dispensing apparatus.

Embodiment 11

As shown in FIG. 19 to FIG. 28, this embodiment provides an intelligent identification assembly, an additive dispensing apparatus and an identification method. By the additive dispensing apparatus 1 of the present disclosure, a user may randomly put different types of liquid storage boxes 2 into any insertion groove in the additive dispensing apparatus 1, there is no need to put according to the set position, and a program is selected to start washing after putting. The intelligent identification assembly 100 in an automatic dispensing apparatus 7 may intelligently identify the type of the additive stored in the liquid storage box 2 in each insertion groove, and feed the type back to a control unit of the additive dispensing apparatus 1, and then the control unit controls a dispensing sequence of the additive in the liquid storage box 2 in each insertion groove according to the washing program.

As shown in FIG. 19 to FIG. 27, this embodiment provides an intelligent identification assembly 100, including:

a contact switch 200, including a wiring terminal 220 and a conductive spring piece 210 which are correspondingly arranged and capable of being in contact connection or disconnected, and the conductive spring piece 210 and the wiring terminal 220 being in a disconnected state in an initial state; and a swing triggering member 300, which is arranged on one side of the contact switch 200 close to the conductive spring piece 210 in a swinging mode.

When swinging under an external force, the swing triggering member 300 may push the conductive spring piece 210 to be in contact conduction with the wiring terminal 220. The conductive spring piece 210 is in contact with the wiring terminal 220 under the pushing of the swing triggering member 300, achieving conduction.

As shown in FIG. 23 to FIG. 27, in the intelligent identification assembly 100 of this embodiment, the swing triggering member 300 is used to push the conductive spring piece 210 to be in contact with the wiring terminal 220, so as to trigger the contact switch 200 to send out an identification signal for conduction. The swing triggering member 300 serves as an intermediate for transmitting a pushing force, which can effectively trigger the conductive spring piece 210 to be conducted with the wiring terminal 220. The structure of the swing triggering member is simple, and implementation is easy.

In the above solution, the wiring terminal 220 and the conductive spring piece 210 may be correspondingly arranged up and down, the conductive spring piece is arranged below the wiring terminal 220, the swing triggering member 300 is arranged below the conductive spring piece 210 in an up-down swinging mode. When swinging upward under an action of the external force, the swing triggering member 300 pushes the conductive spring piece 210 to move upward to be in contact conduction with the wiring terminal 220, and the contact switch 200 is triggered to send out a detection signal for conduction.

The wiring terminal 220 and the conductive spring piece 210 may also be correspondingly arranged left and right, the conductive spring piece is arranged on a left side or a right side of the wiring terminal 220 at a certain distance, the swing triggering member 300 is arranged on a left side or a right side of the conductive spring piece 210 in a left-right swinging mode. When swinging leftward or rightward under the action of the external force, the swing triggering member 300 pushes the conductive spring piece 210 to move leftward or rightward to be in contact conduction with the wiring terminal 220, and the contact switch 200 is triggered to send out the detection signal for conduction.

Figure 25:
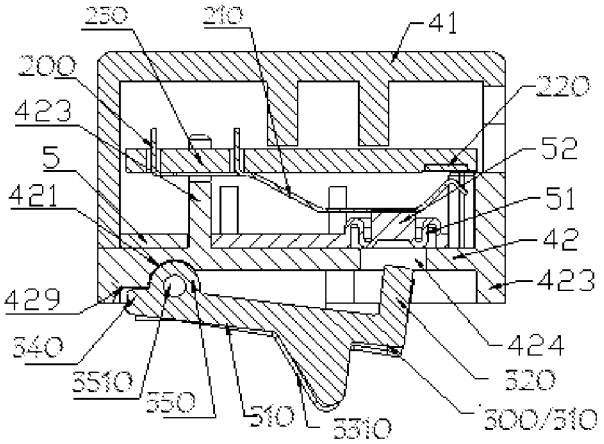
FIG. 25 is a schematic sectional view of an intelligent identification assembly in an embodiment of the present disclosure.
Figure 27:
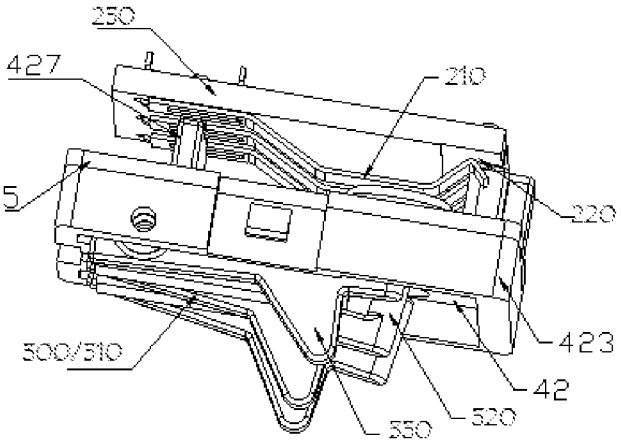
FIG. 27 is a schematic structural diagram from another angle after removing an upper shell body in the intelligent identification assembly in FIG. 23.

Preferably, as shown in FIG. 2, FIG. 25 and FIG. 27, in this embodiment, the wiring terminal 220 and the conductive spring piece 210 are correspondingly arranged up and down, the conductive spring piece is arranged below the wiring terminal 220, and the swing triggering member 300 is arranged below the conductive spring piece 210 in an up-down swinging mode. The swing triggering member 300 drops freely under an action of gravity when not being under the external force. The swing triggering member swings upward under the action of the external force, and the conductive spring piece 210 is pushed to move upward to be in contact conduction with the wiring terminal 220. By adopting the above solution, automatic reset of the swing triggering member 300 may be achieved with the action of the gravity, without the need for additional reset mechanisms and the like. The structure of the whole intelligent identification assembly 100 is more simplified, and the cost is lower.

Further, in this embodiment, the intelligent identification assembly 100 includes a plurality of groups of contact switches 200. The swing triggering members 300 are arranged in one-to-one correspondence with the contact switches 200.

When the swing triggering members 300 of different positions and/or numbers swing under the action of the external force, the conductive spring pieces 210 of the corresponding positions and/or numbers are correspondingly pushed to be in contact connection with the wiring terminals 220, which can achieve that the intelligent identification assembly 100 outputs different combinations of detection signals.

Further, as shown in FIG. 19 to FIG. 21, and FIG. 23 to FIG. 25, the intelligent identification assembly 100 further includes an installation shell 4, including:

an upper shell body 41, wherein the contact switches 200 are arranged in the upper shell body 41, the upper shell body 41 is internally provided with an installation cavity with an opening at a lower end, and the contact switches 200 are arranged in the installation cavity: and a lower cover plate 42, wherein the lower cover plate 42 covers the opening at the lower end of the upper shell body 41, and the swing triggering members 300 is installed below the lower cover plate 42 in an up-down swinging mode.

The swing triggering member 300 includes a swinging rod, one end of the swinging rod is rotatably connected on the lower of the lower cover plate 42, and the other end is capable of pushing the conductive spring pieces 210 to move upward to be in contact connection with the wiring terminals 220.

Preferably, spring piece ejection parts 320 protruding upward are arranged at the ends of the swinging rods in contact with the conductive spring pieces 210. Holes 424 are formed in positions of the lower cover plate 42 corresponding to the spring piece ejection parts 320. When the swinging rods swing upward, the spring piece ejection parts 320 extend into the upper shell body 41 from the holes 424 to push the conductive spring pieces 210 to move upward to be in contact connection with the wiring terminals 220. By arranging the holes 424, the lower cover plate 42 can be effectively prevented from blocking and interfering that the swinging rods move upward to push the conductive spring pieces 210 to be in normal contact connection with the wiring terminals 220.

More preferably, as shown in FIG. 2, FIG. 25 and FIG. 27, the spring piece ejection parts 320 are ejection columns connected with the swinging rods at an included angle not less than 90°. Further preferably, the ejection columns are connected with the swinging rods at the included angle of 90°-120°. Further preferably, in this embodiment, the ejection columns are connected with the swinging rods at the included angle of 90°. In this embodiment, the ejection columns have a certain extension length, and are connected with the swinging rods at the included angle of 90°-120°, so that when the swinging rods move upward, the ejection columns can smoothly extend into the shell body from the holes 424 to push the conductive spring pieces 210 to move upward, without interference or obstruction with the holes 424.

In this embodiment, the ejection columns and the swinging rods are integrally formed by melting, injection molding and/or bonding.

Further, each swinging rod includes a swinging rod body 310 and a swinging rod pushing part 330 for assisting in pushing the swinging rod to move upward, the swinging rod body 310 is a rod with a certain extension length, and an extension direction of the swinging rod body 310 is parallel to an insertion direction of the liquid storage box 2 inserted into the additive dispensing apparatus 1.

As shown in FIG. 2, and FIG. 23 to FIG. 27, each swinging rod pushing part 330 is a protrusion arranged the lower of the swinging rod body 310. After the liquid storage box 2 is inserted into an accommodating part of the additive dispensing apparatus 1, the concave-convex part 61 arranged on the liquid storage box 2 for identifying the type of the additive stored in the liquid storage box 2 abuts against the protrusion on the lower of the swing triggering members 300 at corresponding positions, and push the swinging rod to move upward to push the conductive spring piece 210 to be in contact connection with the wiring terminal 220.

Figure 24:
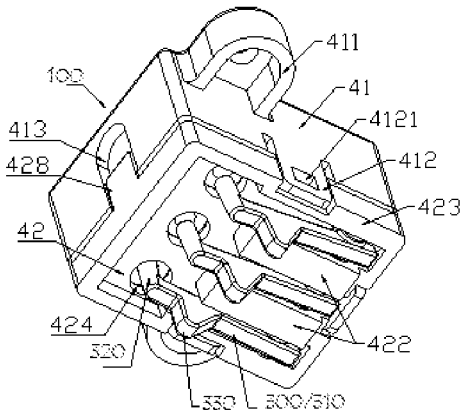
FIG. 24 is a schematic structural diagram from another angle of an intelligent identification assembly in an embodiment of the present disclosure.

Preferably, as shown in FIG. 24, FIG. 25 and FIG. 27, each protrusion is a plate-shaped convex rib connected the lower of the swinging rod body 310, and the plate-shaped convex rib is of a triangular plate-shaped structure. Each plate-shaped convex rib includes an inclined guiding wall 3310 which is gradually inclined downward in a direction from one side of the swinging rod close to the rotating end to the spring piece ejection parts 320. The inclined guiding wall 3310 plays a guiding role, so that after the liquid storage box 2 is inserted into the accommodating part, the concave-convex part 61 on the liquid storage box 2 can abut against the plate-shaped convex rib more smoothly, further to abut against the swinging rods upward.

More preferably, the plate-shaped convex rib is arranged on the swinging rod body 310 between the rotating end of the swinging rod and the spring piece ejection part 320, and the plate-shaped convex rib is arranged at a position of the swinging rod body 310 close to the spring piece ejection part 320. Through the above solution, when there is a slight change in the position of the plate-shaped convex rib, the displacement at the end of the spring piece ejection part 320 may be magnified several times, which can more accurately and efficiently detect and identify the type of the additive stored in the liquid storage box 2.

Further, as shown in FIG. 24 and FIG. 25, the swinging rod further includes a swinging rod limiting part 340 for limiting the downward displacement of the swinging rod. By the arrangement of the swinging rod limiting part 340, it can be effectively avoided that normal drawing and pulling of the liquid storage box 2 is hindered due to excessive downward displacement of the swinging rod.

Preferably, as shown in FIG. 25, the swinging rod limiting part 340 is a limiting section formed by protruding outward from the end of the swinging rod body 310 provided with a rotating shaft hole 3510. A limiting step 429 in limited fit with the limiting section is correspondingly arranged on the lower cover plate 42, and the limiting step 429 has a limiting top wall for limiting the limiting section from moving upward. The limiting step 429 is formed by the limiting top wall and a limiting side wall which are connected at the included angle of 90°. When the swinging rod swings downward, the limiting top wall is above the limiting section for limitation, so that the other end of the swinging rod provided with the spring piece pushing part cannot continue to rotate downward, and is limited and kept at a set initial position.

When the swinging rod is located at the initial position, the swinging rod is in a downward inclined state, and the spring piece ejection part 320 and the conductive spring piece 210 are in a separated and non-contact state. When under an extrusion action of the concave-convex parts 61 on the liquid storage box 2, the swinging rod rotates upward to a triggering position, and the spring piece ejection part 320 at the triggering position is in contact with the conductive spring piece 210 and pushes the conductive spring piece 210 to move upward, so that the conductive spring piece 210 is in contact with the wiring terminal 220.

More preferably, as shown in FIG. 25, a connecting member 350 is arranged on the upper of the swinging rod, and the connecting member 350 is a similar semi-circular structure arranged on the upper of the swinging rod and integrated with the swinging rod, with a circular peripheral wall. The rotating shaft hole 3510 is formed in each connecting member 350. The lower cover plate 42 is provided with an arc groove 421 for allowing the rotation of the connecting member 350. Through the arrangement of the arc groove 421, there is a space for the connecting member 350 of swinging rod during swinging, and the arc groove\ 421 can further play a certain role in limitation, avoiding deflection of positions of the swinging rod. The arc groove 421 is connected with the limiting top wall of the limiting step 429. When the connecting member 350 of the swinging rod rotates along the arc groove 421, the limiting section of at the end of the swinging rod is limited by the limiting top wall of the limiting step 429. The swinging rod is not lower than a height on the initial position when dropping freely downward.

Further, as shown in FIG. 24, a plurality of strip-shaped convex blocks 422 are arranged on a bottom wall of the lower cover plate 42, and an interval space for accommodating the swinging rods is formed between two adjacent convex blocks. An extension direction of the strip-shaped convex blocks 422 is parallel to an extension direction of the swinging rods, the swinging rods are limited in the interval space between two strip-shaped convex blocks 422, and the movement of the swinging rods on the lower cover plate 42 is avoided. So, the normal identification and detection of the intelligent identification assembly 100 are affected.

A first rotating shaft is arranged on each convex block, the rotating shaft hole 3510 is formed in the end of the swinging rods away from the spring piece ejection part 320, and the swinging rod is rotatably installed on the lower cover plate 42 through the rotating shaft hole 3510 and the first rotating shaft. The first rotating shaft is fixedly connected between two adjacent convex blocks, and the swinging rod is rotatably connected to the first rotating shaft.

Preferably, as shown in FIG. 24 to FIG. 27, a circumferential edge of the lower cover plate 42 is folded downward to form a flanging structure 423. The convex blocks are arranged at intervals in a width direction of the lower cover plate 42, a second rotating shaft is arranged between the flanging structure 423 and the convex blocks, and the swinging rod is rotatably installed on the first rotating shaft and/or the second rotating shaft.

Through the flanging structure 423 arranged on the lower cover plate 42, an installation cavity for installing the swing triggering members 300 is formed, the swing triggering members 300 are installed in the installation cavity formed by the lower cover plate 42 and the flanging structure 423 to provide certain protection for the swing triggering members 300. The swing triggering members 300 are not visible from the outside, improving aesthetics. The second rotating shaft may further be arranged between the flanging structure 423 and the convex blocks to install the swinging rods, so that a space below the lower cover plate 42 can be utilized more reasonably.

Figure 26:
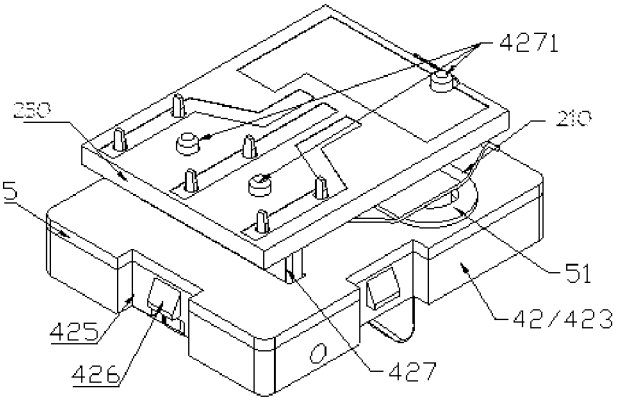
FIG. 26 is a schematic structural diagram from one angle after removing an upper shell body in the intelligent identification assembly in FIG. 23.

Further, as shown in FIG. 25 to FIG. 27, the intelligent identification assembly 100 further includes a waterproof pad 5 arranged between the lower cover plate 42 and the conductive spring piece 210, and the waterproof pad 5 at least blocks upper of the holes 424. Since an environment in the additive dispensing apparatus 1 is high-temperature and high-humidity, and has more impurities, the waterproof pad 5 can effectively solve the problem of accidental contact caused by condensed water and pollutants being in direct contact with the conductive spring pieces 210 in the accommodating cavity.

Preferably, as shown in FIG. 25, the waterproof pad 5 is a flexible rubber film covering the upper of the whole lower cover plate 42. The waterproof pad 5 includes a flexible telescopic sleeve 51 correspondingly blocking the upper of the hole 424. The flexible telescopic sleeve 51 is a corrugated sleeve which is closed and may do telescopic action up and down. Through the flexible telescopic sleeves 51 for blocking the holes 424, a water isolating effect can be ensured, and it may not be affected that the spring piece ejection parts 320 normally push the conductive spring pieces 210 to move.

More preferably, the waterproof pad 5 includes a waterproof pad body covering an upper surface of the lower cover plate 42, and the flexible telescopic sleeve 51 is arranged at a position of the waterproof pad body corresponding to the hole 424. The flexible telescopic sleeve 51 is a flexible rubber film with a plurality of circles of wrinkles, and a plurality of circles of wrinkle structures is as protruding upward or sinking downward, so the telescopic performance of the flexible telescopic sleeve 51 is improved, and the conductive spring pieces 210 can be pushed with the upward movement of the spring piece ejection parts 320. The waterproof pad 5 is provided with the deformable flexible telescopic sleeves 51 in contact with the spring piece ejection parts 320. The deformable flexible telescopic sleeves 51 can extend upward with the movement of the spring piece ejection parts 320, and a pressing action of the swinging rod body 310 is transmitted, so as to trigger the contact switches 200 to be conducted.

More preferably, as shown in FIG. 25, a convex column 52 protruding upward is arranged in a middle position of the flexible rubber film, and an ejection plane in matched contact with the conductive spring pieces 210 is arranged above the convex column 52. When the swinging rods swing upward, the spring piece ejection parts 320 extend into the flexible telescopic sleeves 51 from the holes 424 to push the flexible telescopic sleeves 51 to do telescopic action upward, so as to push the conductive spring pieces 210 to move upward. Through the convex column 52, when pushing the flexible telescopic sleeves 51, the spring piece ejection parts 320 can touch the conductive spring pieces 210 more easily.

In the above solution, when swinging upward, the swing triggering members 300 drive the spring piece ejection parts 320 to press the flexible telescopic sleeves 51, the flexible telescopic sleeves 51 can be deformed, and the swing triggering members 300 press the conductive spring pieces 210 through the convex column of the flexible rubber film to conduct the contact switches 200. Through the above method, the flexible telescopic sleeves 51 transmit movement of the swing triggering members, the contact switches 200 are conducted, and it is completely avoided the effects of high temperature, high humidity, impurities and the like of an interior of the accommodating part 71 of the additive dispensing apparatus 1 on the conduction of the contact switches 200.

In this embodiment, the waterproof pad 5 is made of a rubber material as a whole, and has a good water isolating effect, low costs and a certain elasticity. The body of the waterproof pad 5 may be connected and fixed to an upper of the lower cover plate 42 through a bonding, clamping mode or through a connector.

Since the above intelligent identification assembly 100 is installed at an installation opening 721 formed in an integrated water path on the additive dispensing apparatus 1, the intelligent identification assembly 100 is in direct contact with the liquid storage box 2. An environment of the additive dispensing apparatus 1 is high-temperature and high-humidity, and has certain impurities. The direct contact of the condensed water and pollutants with the conductive spring pieces 210 may lead to the problems of accidental contact and the like. In order to solve the problem, in this embodiment, the above flexible rubber film is installed on the lower cover plate 42. The arrangement can effectively prevent water, dust and other pollutants from polluting the conductive spring pieces 210, so a normal identification detection effect of the intelligent identification assembly 100 is not affected, and the sensitivity and identification efficiency of the intelligent identification assembly 100 are improved.

Further, as shown in FIG. 2, and FIG. 25 to FIG. 27, the conductive spring piece 210 is a spring piece with a long strip-shaped structure. In one implementation, one end of the conductive spring piece 210 is a fixed end, and the other end of the conductive spring piece 210 is a free end. The wiring terminal 220 includes: a first wiring terminal, electrically connected to the fixed end of the spring piece structure; and a second wiring terminal, correspondingly arranged above the free end of the conductive spring piece 210. The free end of the spring piece may be in contact with or separated from the second wiring terminal under the pushing of the swing triggering member 300.

Preferably, as shown in FIG. 25 to FIG. 27, a PCB 230 is fixedly arranged above the lower cover plate 42, and the first wiring terminal and the second wiring terminal are conductive contacts integrally arranged on the PCB 230. The fixed end of the conductive spring piece 210 is connected and fixed to the first wiring terminal, which may be welded to the PCB 230, and the other free end of the conductive spring piece 210 may move upward to be in contact with or separated from the second wiring terminal under the pushing of the swing triggering members 300.

A limiting support plate 427 for supporting and fixing the PCB 230 is arranged on the lower cover plate 42. The limiting support plate 427 is fixedly arranged on the upper surface of the lower cover plate 42, and is distributed and arranged at front and rear ends of the lower cover plate 42 to provide a more balanced and stable support force for the PCB 230.

As shown in FIG. 25 to FIG. 27, a top of the limiting support plate 427 has a supporting surface for contact with a lower surface of the PCB 230. Preferably, a limiting column 4271 protruding upward is arranged on the limiting support plate 427, the PCB 230 is correspondingly provided with a limiting hole, and the limiting column 4271 penetrates through the limiting hole in the PCB 230. A circumferential direction of the PCB 230 is limited and fixed through the match between the limiting column 4271 and the limiting hole, which avoids deflection and movement of a position of the PCB 230 in a horizontal direction.

More preferably, an annular boss is arranged at a top of the limiting column 4271, so as to clamp and limit the PCB 230 on the limiting support plate 427. Or, an external thread is arranged on the limiting column 4271, and the PCB 230 is fixed on the limiting support plate 427 through a nut.

Alternatively, as shown in FIG. 25, a plurality of vertical limiting rods extending downward are arranged in the upper shell body 41, lower end parts of the vertical limiting rods extend to the upper surface of the PCB 230. The vertical limiting rods may abut against the upper surface of the PCB 230 or has a small gap with the upper surface of the PCB 230. The supporting surface at the upper end of the limiting support plate 427 is supported on the lower surface of the PCB 230, and the PCB 230 is clamped and fixed between the limiting support plate 427 and the vertical limiting rods.

This embodiment provides another setting mode of the conductive spring pieces 210 and the wiring terminals 220. The difference from the above implementation is that the conductive spring pieces 210 are freely arranged below the PCB 230, with two ends not fixed.

Specifically, the conductive spring pieces 210 are movably arranged below the PCB 230 in an up-down moving mode. At least one vertical guiding rod is arranged on the conductive spring pieces 210, a guiding hole is formed in the PCB 230, and the vertical guiding rod is movably arranged in the guiding hole up and down.

In a natural state, the conductive spring pieces 210 are supported and fixed on the limiting support plate 427 under the action of the gravity, the conductive spring pieces 210 are not substantially connected with the limiting support plate 427 and the PCB 230. Limiting holes matched with the limiting column 4271 on the limiting support plate 427 are formed in the conductive spring pieces 210, and the limiting column 4271 penetrates through the limiting holes of the conductive spring pieces 210 and the PCB 230 sequentially to limit the conductive spring pieces 210 and the PCB 230 in a circumferential direction. First wiring terminals and second wiring terminals are arranged on the PCB 230 at intervals, the conductive spring pieces 210 move upward as a whole under an action of a swing pushing force, to be in contact with the first wiring terminals and the second wiring terminals respectively, and a circuit between the first wiring terminals and the second wiring terminals is conducted.

Figure 21:
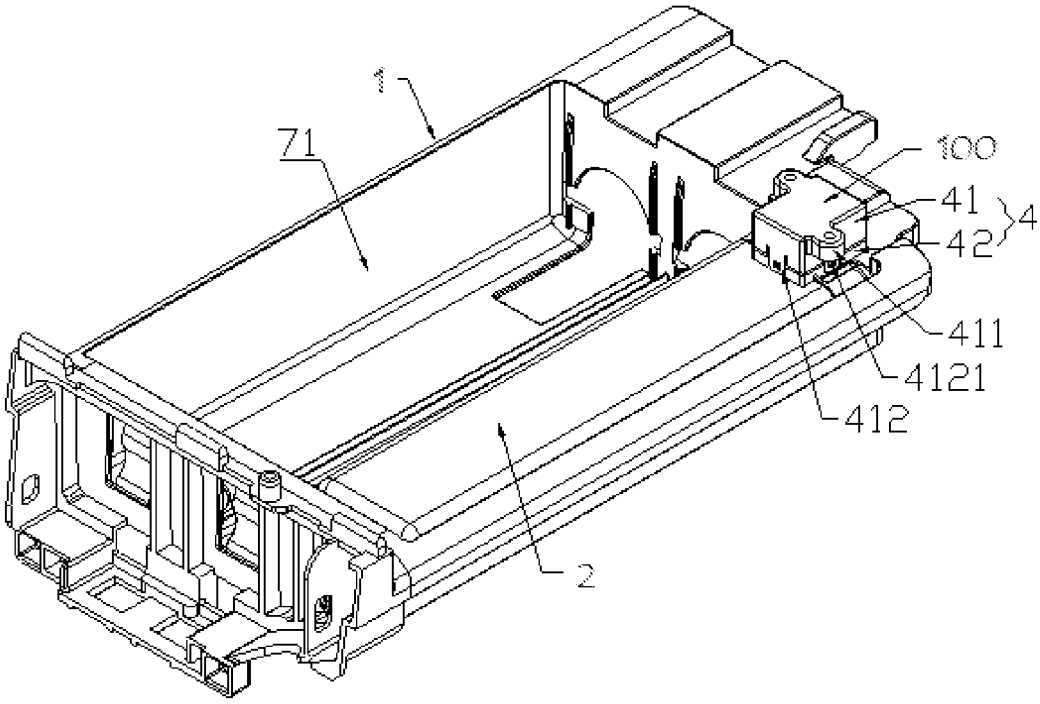
FIG. 21 is a schematic structural diagram of an additive dispensing apparatus after removing an integrated cover plate.
Figure 23:
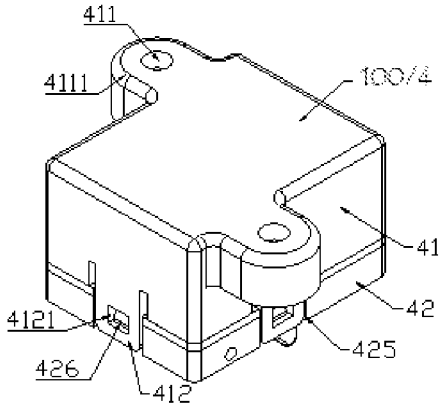
FIG. 23 is a schematic structural diagram from one angle of an intelligent identification assembly in an embodiment of the present disclosure.

In this embodiment, as shown in FIG. 21, FIG. 23 and FIG. 24, the upper shell body 41 and the lower cover plate 42 of the installation shell 4 are connected and fixed in a clamping mode. A clamping platform 426 is arranged on a peripheral wall of the flanging structure 423 of the lower cover plate 42, the upper shell body 41 includes a top wall and a peripheral wall, and the peripheral wall of the upper shell body 41 is provided with a clamping jaw or a clamping groove 4121 which is clamped and matched with the clamping platform 426. The upper shell body 41 and the lower cover plate 42 are connected and fixed in a clamping mode, assembly and connection of the two may be achieved without the help of other connectors, and disassembly and installation are more convenient and faster.

Preferably, in this embodiment, as shown in FIG. 23, the upper shell body 41 is in clamped fit with the lower cover plate 42 through the clamping groove 4121 and the clamping platform 426. An extension plate 412 extending downward is arranged on the peripheral wall of the upper shell body 41, a limiting groove 425 matched with the extension plate 412 is correspondingly formed in the outer wall of the flanging structure 423 of the lower cover plate 42, the clamping platform 426 is arranged on an outer wall of the limiting groove 425, and the clamping groove 4121 is formed in the extension plate 412. After the upper shell body 41 is buckled with the lower cover plate 42, the extension plate 412 extends into the limiting groove 425, the clamping platform 426 is clamped into the clamping groove 4121 of the extension plate 412, so the upper shell body 41 is in clamped fit with the lower cover plate 42 through the clamping groove 4121 and the clamping platform 426, and the stability is higher.

Further, as shown in FIG. 23, the extension plate 412 and the limiting groove 425, as well as the clamping groove 4121 and the clamping platform 426 are respectively arranged on left and right side walls of the installation shell 4 opposite to each other. Preferably, at least one of front and rear side walls of the installation shell 4 is provided with a positioning structure for positioning the upper shell body 41 and the lower cover plate 42. As shown in FIG. 24, the positioning structure includes a positioning insertion plate 428 on the lower cover plate 42 and a positioning insertion groove 413 correspondingly formed in the peripheral wall of the upper shell body 41. The positioning insertion plate 428 is formed by upward extension of a part of an outer edge of the upper cover plate, and the positioning insertion groove 413 is an opening groove formed in a peripheral wall edge of the installation shell 4. Through the arranged positioning insertion plate 4128 and positioning insertion groove 413, the stability of matching between the upper shell body 41 and the lower cover plate 42 can be enhanced, and the assembly efficiency of the upper shell body 41 and the lower cover plate 42 can be effectively provided.

Embodiment 12

Figure 28:
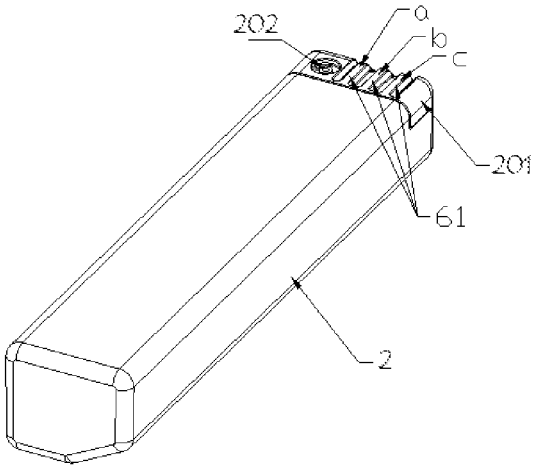
FIG. 28 is a schematic structural diagram of a liquid storage box in an embodiment of the present disclosure.

As shown in FIG. 19 to FIG. 28, this embodiment introduces a liquid storage box 2, the liquid storage box 2 is internally provided with a sealing cavity for storing additives. As shown in FIG. 28, at least one concave-convex part 61 is arranged on an outer wall of the liquid storage box 2, and a combination of the number and position of the concave-convex parts 61 arranged on the liquid storage box 2 correspondingly represents type of the additive stored in the liquid storage box 2.

At least one concave-convex part 61 is arranged on the liquid storage box 2 and exposed on the outer wall, and the type of the additive contained in the liquid storage box 2 is accurately identified by using any one or a combination of information such as the number, relative position and setting position on the liquid storage box 2 of the concave-convex parts 61.*s* Type information of the additive in different liquid storage boxes 2 is clearly identified.

In the embodiment of the present disclosure, there may be various liquid storage boxes 2, and the various liquid storage boxes 2 are used for containing different types of additives correspondingly. Concave-convex parts 61 with any one or a combination of the number and position being different are arranged on the liquid storage boxes 2 for storing the different types of additives. In the embodiment of the present disclosure, the types of the additives include the following: a detergent, an odorant, a softener, a disinfectant, etc., and the different type of additives may be correspondingly dispensed separately or in combination. When the clothing treatment device executes different programs, the different types of additives are correspondingly used to correspondingly treat laundry. In the embodiment of the present disclosure, each liquid storage box 2 installed on the additive dispensing apparatus 1 may further store detergents with different concentrations respectively, such as super concentrated, concentrated, ordinary and low foam. Correspondingly the detergents of corresponding categories are dispensed when the clothing treatment device executes different washing programs, so that different pieces of laundry are correspondingly washed, and a washing effect of the clothing treatment apparatus is improved.

In a first implementation:

As shown in FIG. 19 to FIG. 22, and FIG. 28, in this implementation, the position of the concave-convex parts 61 arranged on the liquid storage box 2 correspondingly represents the types of the additives stored in the liquid storage boxes 2. In this embodiment, the concave-convex parts 61 are arranged at different positions on the outer walls of the liquid storage boxes 2 for storing different types of additives.

In this embodiment, the concave-convex parts 61 are protrusions protruding outward from the outer walls of the liquid storage boxes 2. In this embodiment, in the figure, for the convenience of expression, the concave-convex parts 61 are all represented as the protrusions protruding outward from the outer walls of the liquid storage boxes 2.

In this embodiment, the concave-convex parts 61 may be integrally formed with the liquid storage boxes 2 and directly formed by the outer walls of the liquid storage boxes 2. Or, the concave-convex parts 61 are separated from the liquid storage boxes 2, and formed by independent components installed on the outer walls of the liquid storage boxes 2. In this embodiment, the concave-convex parts 61 may be made of any material, but it needs to ensure that when the concave-convex parts 61 are in contact with the swing triggering members 300 of the intelligent identification assembly 100, extrusion contact with the swing triggering members 300 may be generated due to protruding, so that the contact switches 200 generate triggering signals.

Preferably, in this embodiment, in order to further improve the action accuracy of the concave-convex parts 61 on the contact switches 200, the following settings may be made. At least part of the outer wall of the liquid storage box 2 is a smooth surface, the smooth outer wall surface is provided with parts that produce concave and convex changes in an inner and outer direction of the liquid storage box 2, and the parts with the concave and convex changes form the concave-convex parts 61. So, the positions where the concave-convex parts 61 are formed are smooth planes with height changes, so as to improve triggering sensitivity when the concave-convex parts 61 are in contact with the swing triggering members 300.

In this embodiment, the concave-convex parts 61 may be designed into any shape, such as a circle, a square, an ellipse, a polygon and any other shape and structure. In this embodiment, in order to ensure to the accurately detect the concave-convex parts 61, generally, all concave-convex parts 61 arranged on the liquid storage box 2 have the same shape. The replacement convenience and aesthetic appearance of the liquid storage box 2 are improved.

Figure 22:
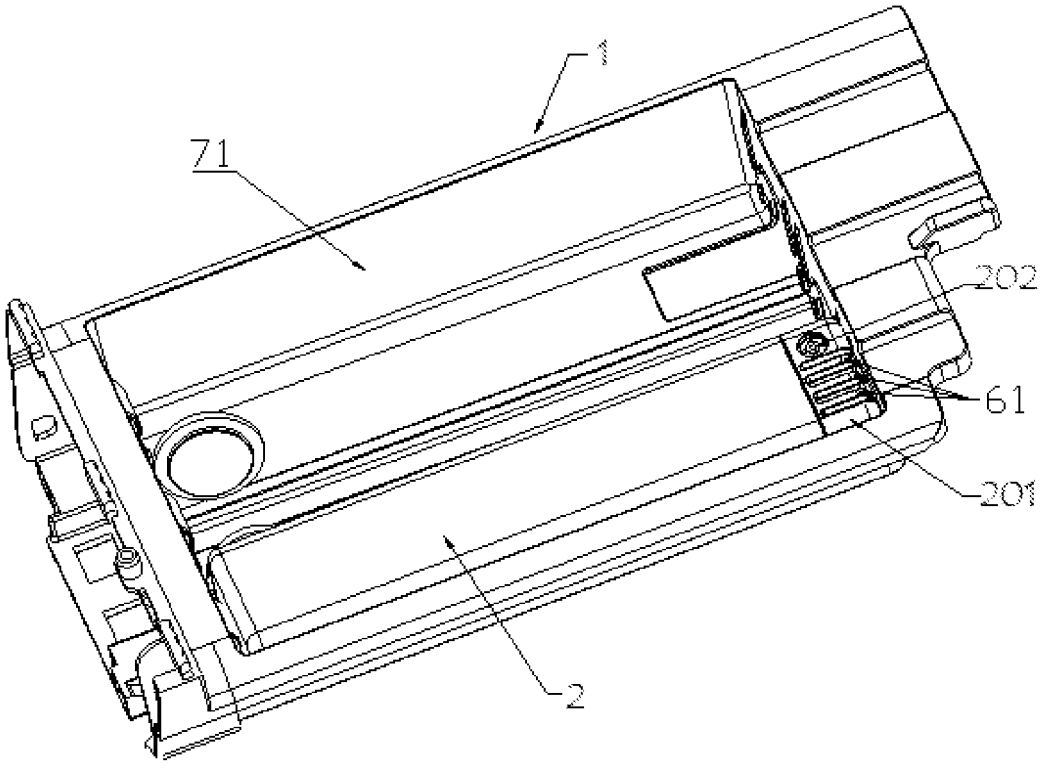
FIG. 22 is a schematic structural diagram of an additive dispensing apparatus after removing an intelligent identification assembly.

Preferably, as shown in FIG. 22 and FIG. 28, in this embodiment, an identifier cover 201 is arranged on the liquid storage box 2, and the concave-convex parts 61 are arranged on the identifier cover 201. Through the identifier cover 201, processing the concave-convex parts 61 on the identifier cover 201 is more convenient and easier compared to a manner of directly processing on a box body of the liquid storage box 2, and the production and manufacturing efficiency of the liquid storage box 2 is improved.

Further, the identifier cover 201 may be an independent component arranged on the top wall of the liquid storage box 2. Preferably, in this embodiment, the identifier cover 201 is a partial structure of the liquid storage box 2, and is arranged at a position of the top wall of the liquid storage box 2 close to the front end. In this way, the identifier cover 201 may be used as a carrier for arranging the concave-convex parts 61, and also forms the partial structure of the liquid storage box 2, which makes it versatile and reducing the cost.

More preferably, an opening is formed in a top wall of the box body of the liquid storage box 2, and the identifier cover 201 is installed at the opening. The identifier cover 201 is an independent member, and is assembled into the liquid storage box 2 to form an independent closed cavity inside.

Or, the identifier cover 201 is integrally formed with the box body of the liquid storage box 2, the identifier cover 201 is integrally formed with the liquid storage box 2 by adopting a blow molding process. The process is simplified, and the manufacturing cost is reduced.

Preferably, as shown in FIG. 22 and FIG. 28, a one-way breather valve 202 is installed on the identifier cover 201 to balance a pressure difference between an interior and an exterior of the liquid storage box 2. It is ensured that the additives in the liquid storage box 2 can be smoothly extracted.

An installation hole for installing the one-way breather valve 202 is formed in the identifier cover 201, and the one-way breather valve 202 is installed in the installation hole in a sealing mode. Compared to a manner of installing the one-way breather valve at other positions of the box body of the liquid storage box 2, by installing the one-way breather valve 202 on the identifier cover 201, processing and manufacturing are convenient, and the processing process of the liquid storage box 2 is further simplified.

As shown in FIG. 28, in this embodiment, the information of the concave-convex parts 61 arranged on the liquid storage box 2 includes position information of the concave-convex parts 61 on the liquid storage box 2.

For example, a concave-convex part 61 arranged on a detergent liquid storage box 2 for containing a detergent is located at a position a. A concave-convex part 61 arranged on a bleach liquid storage box 2 for containing a bleach is located at a position b. A concave-convex part 61 arranged on a disinfectant liquid storage box 2 for containing a disinfectant is located at a position c, and so on.

In a second implementation:

As shown in FIG. 22 and FIG. 28, in this implementation, two or more concave-convex parts 61 are arranged on an outer surface of the liquid storage box 2, and every two concave-convex parts 61 are spaced at an interval, so that all concave-convex parts 61 are distributed at different positions of the liquid storage box 2 in a mode that the position is changeable. A combination of the number and position of the concave-convex parts 61 arranged on the liquid storage box 2 correspondingly represents the type of the additive stored in the liquid storage box 2.

In this embodiment, the information of the concave-convex parts 61 is the number of the concave-convex parts 61 arranged on the outer surface of the liquid storage box 2.

For example, two concave-convex parts 61 are arranged on the detergent liquid storage box 2 for containing the detergent, three concave-convex parts 61 are arranged the bleach liquid storage box 2 for containing the bleach, one concave-convex part 61 is arranged on the disinfectant liquid storage box 2 for containing the disinfectant, and so on.

In this embodiment, the information of the concave-convex parts 61 includes distance information, relative spatial orientation information and position information arranged on the liquid storage box 2 among the concave-convex parts 61.

For example: the concave-convex parts 61 are arranged at a position a, a position b and a position c on the liquid storage box 2 for containing the detergent respectively, the concave-convex parts 61 are arranged at a position a and a position b on the liquid storage box 2 for containing the bleach respectively, the concave-convex parts 61 are arranged at a position a and a position c on the liquid storage box 2 for containing the disinfectant respectively, and so on.

In this embodiment, the number information and the position information of the concave-convex parts 61 may further be correspondingly combined, so as to correspond more types of the additives.

Embodiment 13

As shown in FIG. 19 to FIG. 28, this embodiment further provides an additive dispensing apparatus 1, including a liquid storage box 2 in Embodiment 2 and an accommodating part 71 for installing the liquid storage box 2, and the intelligent identification assembly 100 in above Embodiment 1 is arranged in the accommodating part 71.

In this embodiment, at least one concave-convex part 61 is arranged on an outer wall of the liquid storage box 2, and any one or a combination of the number and position of the concave-convex parts 61 arranged on the liquid storage box 2 correspondingly represents type of the additive stored in the liquid storage box 2.

As shown in FIG. 19 to FIG. 24, positions of the swing triggering members 300 correspond to positions of the concave-convex parts 61, and may cover all concave-convex parts 61 on the liquid storage boxes 2 for different types of additives. All concave-convex parts 61 on the liquid storage box 2 abut against the swing triggering members 300 at corresponding positions, and press the swing triggering members 300 to swing in a direction close to the conductive spring pieces 210. The concave-convex parts 61 may be arranged on any one of upper, lower, left and right side walls of the liquid storage box 2, as long as it can ensure that the concave-convex parts 61 can be in contact with the swing triggering members 300 of the intelligent identification assembly 100 after the liquid storage box 2 is inserted into the accommodating part 71. The swing triggering members 300 may be pressed and triggered by the concave-convex parts, so that the contact switches 200 generate triggering signals.

Preferably, in this embodiment, as shown in FIG. 22 and FIG. 28, the concave-convex parts 61 are arranged on a top wall of the liquid storage box 2. The accommodating part 71 is formed by a cavity for installing the liquid storage box 2 and an integrated cover plate 72 arranged above the cavity, and the intelligent identification assembly 100 is correspondingly installed on the integrated cover plate 72. A water feeding path of the additive dispensing apparatus 1 is integrated on the integrated cover plate 72.

Figure 19:
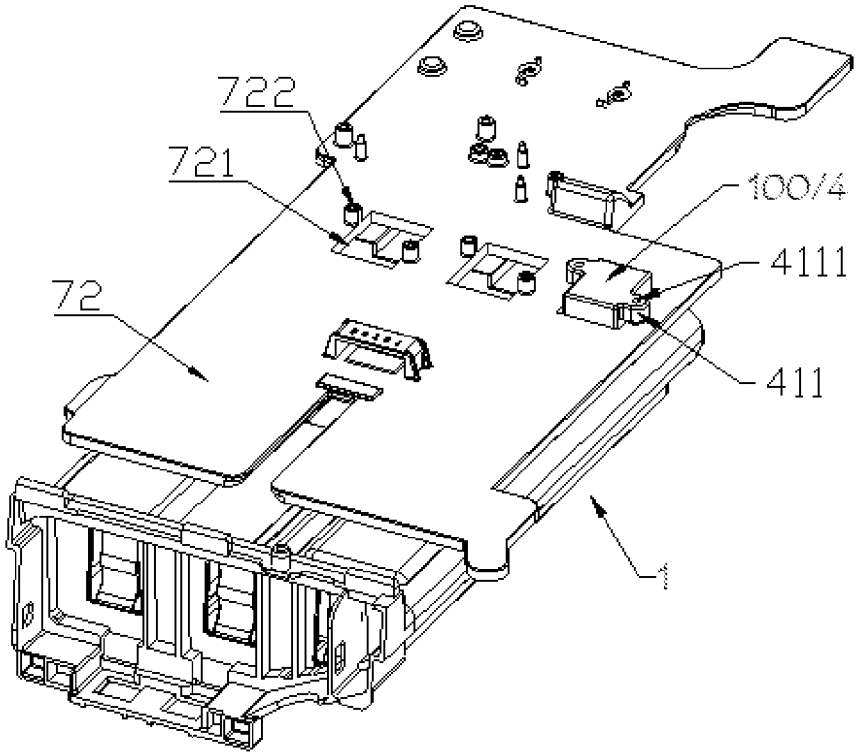
FIG. 19 is a schematic structural diagram of an additive dispensing apparatus in an embodiment of the present disclosure.
Figure 20:
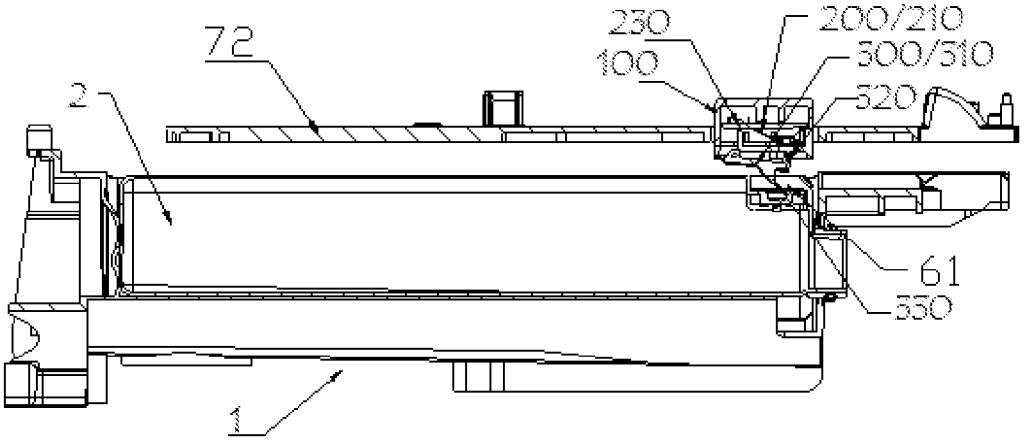
FIG. 20 is a schematic sectional view of an additive dispensing apparatus in an embodiment of the disclosure.

Further, as shown in FIG. 19, the integrated cover plate 72 is provided with an installation opening 721 for installing the intelligent identification assembly 100, and the installation opening 721 is matched with a peripheral wall of the installation shell 4 of the intelligent identification assembly 100. A connection part 411 protruding outward is arranged on the upper peripheral wall of the installation shell 4, and a threaded hole 4111 is formed in the connection part 411. A bolt column 722 is correspondingly arranged on the integrated cover plate 72, and the intelligent identification assembly 100 is fixed to the integrated cover plate 72 through a screw.

Preferably, as shown in FIG. 19, there are two connection parts 411, which are diagonally arranged on the peripheral wall of the installation shell 4. There are also two bolt columns 722, which are diagonally and symmetrically arranged at the installation opening 721. The connection parts 411 and the bolt columns 722 are diagonally arranged, so the intelligent identification assembly 100 may be stably and firmly installed on the integrated cover plate 72 through two screws, and connection is reliable.

More preferably, an identification unit is provided for determining the type of the additive in the liquid storage box 2 based on information of the contact switches 200 in contact with the concave-convex parts 61.

In this embodiment, the identification unit is integrated on or independently arranged outside the additive dispensing apparatus 1. The identification unit may acquire the information of the contact switches 200 in contact with the concave-convex parts 61 under the pushing of the swing triggering members 300, and compare the acquired information of the contact switches 200 in contact with the concave-convex parts 61 under the pushing of the swing triggering members 300 with a prestored database to obtain type information of the additives in the liquid storage box 2 corresponding to the acquired information of the contact switches 200 in contact with the concave-convex parts 61. The type of the additive in the liquid storage box 2 is accurately determined.

In this embodiment, the identification unit may be directly arranged on the additive dispensing apparatus 1, or may be arranged on a clothing treatment apparatus with the additive dispensing apparatus 1, or may further be arranged on a cloud server, a mobile terminal and other intelligent terminals being in communication with the additive dispensing apparatus 1.

This embodiment further provides an identification method for the above additive dispensing apparatus 1, including:

putting a liquid storage box 2 into an accommodating part of the additive dispensing apparatus 1;

each concave-convex part 61 on the liquid storage box 2 abutting against the swing triggering members 300 of the intelligent identification assembly 100, so that the swing triggering members 300 swing towards the conductive spring pieces 210, to push the conductive spring pieces 210 at corresponding positions to be in contact conduction with the wiring terminals 220; and determining the type of additive in the liquid storage box 2 based on signal information of the wiring terminals 220 in contact conduction with each conductive spring piece 210.

Through the above method, after different liquid storage boxes 2 are inserted into the accommodating part of the additive dispensing apparatus 1, the concave-convex parts 61 with different positions and/or different numbers on the liquid storage boxes 2 are in contact with the swing triggering members 300 at corresponding positions to generate press action, push the different swing triggering members 300 to rotate upward, so that the conductive spring pieces 210 at corresponding positions are in contact conduction with the wiring terminals 220. Thus, circuit is conducted and outputs signals. The numbers and/or positions of the concave-convex parts 61 on the liquid storage boxes 2 for different types of additives are different, so different swing triggering members 300 are pushed, and on-off situations of all contact switches 200 are also different, so that the intelligent identification assembly 100 can output different combinations of detection signals. The type of the additive is accurately determined by identifying the concave-convex parts 61 arranged on the liquid storage boxes 2.

In the present application, after the liquid storage box 2 is pushed into the accommodating part 71, the concave-convex part on the liquid storage box 2 are presses the swinging rod pushing part 330 of the swing triggering member 300. So, the swinging rod body 310 at corresponding position moves upward around the rotating shaft, and the spring piece ejection part 320 above the swinging rod body 310 pushes the conductive spring piece 210 to be in contact with the wiring terminal 220 or conductive contact on the PCB 230. The circuit is conducted and outputs the signals.

Through the swing triggering members 300, the drawing and pulling motion of the liquid storage box 2 in front-rear direction may make the swinging rod body 310 move in up-down direction, so as to trigger the corresponding contact switch 200. The swing triggering member 300 can play a role in reversing and transmitting the force, so it is more convenience to operate for the intelligent identification assembly 100. The different concave-convex parts 61 of different liquid storage boxes push correspondingly the swing triggering members 300, so different signals are output, thereby identifying the types of the additives stored in the liquid storage boxes 2.

The above descriptions are only preferred embodiments of the present disclosure and do not limit the present disclosure in any form. Although the present disclosure has been disclosed in the preferred embodiments, it is not intended to limit the present disclosure. Any technical personnel familiar with the present patent, within the scope of the technical solution of the present disclosure, may make some changes or modifications to equivalent embodiments by utilizing the technical content mentioned above. Any simple modifications, equivalent changes, and modifications made to the above embodiments based on the technical essence of the present disclosure, which are not separated from the technical solution of the present disclosure, still fall within the scope of the solution of the present disclosure.

The invention claimed is:

1. A liquid storage box, internally provided with a closed cavity for storing additives, wherein at least one guiding identifier part with a set guiding trajectory is arranged on an outer wall of the liquid storage box; and any one or a combination of a number, position and trajectory shape of the guiding identifier part arranged on the liquid storage box correspondingly represents types of the additives stored in the liquid storage box.

2. The liquid storage box according to claim 1, wherein the guiding identifier part is a guiding rib and/or a guiding groove arranged on the outer wall of the liquid storage box in an insertion and extraction direction of the liquid storage box;

preferably, the guiding rib and/or the guiding groove is arranged on a top wall of the liquid storage box.

3. The liquid storage box according to claim 2, wherein the top wall of the liquid storage box sinks inward to form the guiding groove, and the guiding groove has a guiding wall that can change a direction of the guiding trajectory; and/or the top wall of the liquid storage box protrudes outward to form the guiding rib, and the guiding rib has a guiding wall that can change the direction of the guiding trajectory.

4. The liquid storage box according to claim 2, wherein the liquid storage box is provided with an identifier cover, and the guiding rib and/or the guiding groove is arranged on the identifier cover.

5. An additive dispensing apparatus, provided with an insertion groove for installing the liquid storage box according to claim 1, wherein an intelligent identification assembly for identifying types of additives in the liquid storage box is correspondingly arranged in the insertion groove, the intelligent identification assembly includes:

a wiring terminal, including a first wiring terminal and a second wiring terminal which are connected to a detection circuit;

an elastic pushing member, including a conductive element that is in contact and electrical connection between the first wiring terminal and the second wiring terminal in initial state; and a rotating swing member, which may swing along the set guiding trajectory of the guiding identifier part on the liquid storage box and push the elastic pushing member at corresponding position to disconnect the conductive element from the wiring terminal when the liquid storage box is inserted into the insertion groove, achieving signal identification.

6. The additive dispensing apparatus according to claim 5, wherein the additive dispensing apparatus includes an upper cover plate located at a top of the insertion groove, the rotating swing member includes a swing part, wherein a rotating shaft which is rotatably connected to the upper cover plate is arranged on an upper end surface of the swing part, a guiding column is arranged on a lower end surface of the swing part, and the guiding column may move along the guiding trajectory of the guiding identifier part to drive the swing part to swing;

an abutting part, connected to the swing part at a set included angle, deflecting with the swinging of the swing part, and extruding the elastic pushing member to disconnect the conductive element from the wiring terminal.

7. The additive dispensing apparatus according to claim 5, wherein the elastic pushing member includes:

a barrel shell, fixed to the upper cover plate;

a sliding push rod, with one end located outside the barrel shell and abutting against the abutting part, and the other end extending into the barrel shell to abut an end of the conductive element; and a conductive element, movably arranged in the barrel shell, with two ends being in contact and electrical connection with the first wiring terminal and the second wiring terminal respectively;

the rotating swing member swings to drive the abutting part to deflect and abut against the sliding push rod, and the sliding push rod pushes the conductive element to move, so as to disconnect at least one end of the conductive element from its corresponding wiring terminal, achieving signal identification.

8. The additive dispensing apparatus according to claim 7, wherein the intelligent identification assembly is fixed to the upper cover plate through an installation seat, the installation seat is internally provided with an accommodating cavity, and the elastic pushing member is installed in the accommodating cavity.

9. An intelligent identification assembly according to claim 5 includes a contact switch including a wiring terminal and a conductive spring piece which are correspondingly arranged and may be in contact or disconnected from each other, and the conductive spring piece and the wiring terminal being in a disconnected state in an initial state; and a swing triggering member, which is arranged on one side of the contact switch close to the conductive spring piece in a swinging mode and may push the conductive spring piece to be in contact conduction with the wiring terminal when the swing triggering member swings under an external force.

10. The intelligent identification assembly according to claim 9, wherein the intelligent identification assembly further includes an installation shell, and the installation shell includes: an upper shell body, the contact switch being arranged in the upper shell body; and a lower cover plate, and the swing triggering member being installed below the lower cover plate in an up-down swinging mode; the swing triggering member includes a swinging rod with one end rotatably connected below the lower cover plate, and an other end can push the conductive spring piece to move upward to be in contact connection with the wiring terminal.

11. The intelligent identification assembly according to claim 10, wherein a plurality of strip-shaped convex blocks are arranged on a bottom wall of the lower cover plate, and an interval space that accommodates the swinging rod is formed between two adjacent convex blocks; a first rotating shaft is arranged on each of the convex blocks, a rotating shaft hole is formed in one end of the swinging rod away from the spring piece ejection part, and the swinging rod is rotatably installed on the lower cover plate through the rotating shaft hole and the first rotating shaft.

12. The intelligent identification assembly according to claim 10, wherein the swinging rod includes a swinging rod body and a swinging rod pushing part for assisting in pushing the swinging rod to move upward, and the swinging rod pushing part is a protrusion arranged below the swinging rod body.

13. The intelligent identification assembly according to claim 12, wherein the swinging rod further includes a swinging rod limiting part for limiting a displacement of the swinging rod falling downward.

14. A sealing cover of the liquid storage box according to claim 1, wherein the sealing cover is installed at a dispensing port of the liquid storage box, and the dispensing port is closed under a normal conditions to form a closed cavity for storing additives in the liquid storage box; and an identification apparatus for identifying categories and/or remaining quantities of the additives in the liquid storage box is arranged on the sealing cover.

15. The sealing cover of the liquid storage box according to claim 14, wherein the identification apparatus includes at least two conductive contact pieces which are in contact with the additives in the liquid storage box and arranged on the sealing cover, and any one or a combination of a number and a position of the conductive contact pieces arranged on the sealing cover correspondingly represents types of the additives stored in the liquid storage box.

16. The sealing cover of the liquid storage box according to claim 15, wherein the identification apparatus further includes a conductive probe arranged on the sealing cover and extending into the closed cavity, the conductive contact piece exposed on an outer wall surface of the sealing cover is connected to the conductive probe, and the conductive contact piece is conducted with the additives in the closed cavity through the conductive probe.

17. The sealing cover of the liquid storage box according to claim 16, wherein the sealing cover includes a connecting sleeve with an outlet end located at the dispensing port of the liquid storage box and an inlet end extending into the liquid storage box, and the connecting sleeve is internally provided with a flow guide channel; and the sealing cover further includes a clamping end cap connected to the outlet end of the connecting sleeve and installed at the dispensing port in a sealing mode, and the conductive contact piece is arranged on the clamping end cap.

18. The sealing cover of the liquid storage box according to claim 15, wherein a first conductive contact piece and a second conductive contact piece which are spaced at different intervals are arranged on the sealing cover, and the interval correspondingly represents the types of the additives stored in the liquid storage box.

19. The sealing cover of the liquid storage box according to claim 11, wherein the identification apparatus further includes at least one photosensitive component arranged on the sealing cover, and any one or any combination of a number, position and transmittance of the photosensitive component correspondingly represents the types of the additives stored in the liquid storage box.

20. The sealing cover of the liquid storage box according to claim 11, wherein the identification apparatus further includes a crystal oscillator which is arranged in the sealing cover and may generate different frequencies, the crystal oscillator with different frequencies corresponds to different parameter information of the additives contained in the liquid storage box, and the parameter information at least includes category information of the additives.

* * * * *